US005955689A

United States Patent [19]

Feiten et al.

[11] Patent Number: 5,955,689

[45] Date of Patent: Sep. 21, 1999

[54] METHOD AND APPARATUS FOR FULLY ADJUSTING AND PROVIDING TEMPERED INTONATION FOR STRINGED, FRETTED MUSICAL INSTRUMENTS, AND MAKING ADJUSTMENTS TO THE RULE OF 18

[76] Inventors: Howard B. Feiten, Los Angeles; Gregory T. Back, Pacific Palisades, both of Calif.

[21] Appl. No.: 08/886,645

[22] Filed: Jul. 1, 1997

Related U.S. Application Data

[63] Continuation-in-part of application No. 08/698,174, Aug. 15, 1996, Pat. No. 5,814,745.

[51] Int. Cl.[6] ..... G10D 3/14

[52] U.S. Cl. ..... 84/312 R; 84/455

[58] Field of Search ..... 84/312 R, 454, 84/455

[56] References Cited

U.S. PATENT DOCUMENTS

| | | | |
|---|---|---|---|
| 265,835 | 8/1882 | Rickard | 403/67 |
| 3,237,502 | 3/1966 | Moseley | 84/267 |
| 3,599,524 | 8/1971 | Jones | 84/412 |
| 4,004,482 | 1/1977 | Yates | 84/455 |
| 4,236,433 | 12/1980 | Holland | 84/726 |
| 4,643,069 | 2/1987 | Borisoff et al. | 84/306 |
| 4,655,116 | 4/1987 | Matsui | 84/312 R |
| 4,911,055 | 3/1990 | Cipriani | 84/299 |
| 4,951,543 | 8/1990 | Cipriani | 84/298 |
| 5,052,260 | 10/1991 | Cipriani | 84/298 |
| 5,063,818 | 11/1991 | Salazar | 84/314 R |
| 5,208,410 | 5/1993 | Foley | 84/307 |
| 5,404,783 | 4/1995 | Feiten et al. | 84/298 |
| 5,600,079 | 2/1997 | Feiten et al. | 84/312 R |

OTHER PUBLICATIONS

Cipriani Bridge Systems Brochure (1992).

Brian Rabey, "Into the Fire. Steve Vai Talks Tone and Shows Us His Private Studio," *Guitar Shop*, pp. 37–38, Feb., 1997.

Steve Vai, "A Walk in the Fire Garden," *Guitar*, pp. 56–57, Oct., 1996.

Lisa Sharken, "You Can Tune a Strat, Buy Can You Tuna Fish? The Amazing Buzz Feiten Tuning System for Guitars," *Guitar Shop*, pp. 14–16, Dec., 1996.

Art Thompson, "The Buzz Feiten Tuning System," *Guitar Player*, p. 121, Oct., 1996.

*Primary Examiner*—William M. Shoop, Jr.
*Assistant Examiner*—Shih-yung Hsieh
*Attorney, Agent, or Firm*—Lyon & Lyon LLP

[57] ABSTRACT

A fully adjustable acoustic guitar bridge is claimed that allows the strings (e.g. nylon or steel) of an acoustic guitar to be separately and continuously intonated, accurately and easily, whenever necessary. The bridge system employs a minimum of alterations to the traditional non-adjustable acoustic guitar bridge to retain the acoustic qualities of the instrument. In one embodiment, recessed rear-loaded cap screws utilize the forward and downward pull of the strings to stabilize the adjustable saddles; in another, recessed, front-loaded cap screws utilize a c-clip to stabilize the saddles. A threaded saddle capture on each saddle provides stability, continuous threading capability, and the freedom to use acoustically resonant materials (e.g. bone, phenolic, composites, etc.) for saddles. In one embodiment, the string's downward pressure transmits string vibration to the soundboard; in another, a set-screw assists this transference of sound. In one embodiment, a rosewood shim is employed on acoustic/electric guitars over the internal bridge pickup. The vibration of the saddles on the shim is transmitted to the pickup regardless, if the saddles are located directly over the pickup or not. The system has been tested and is compatible with most bridge pickup systems that are currently on the market. The Rules of 3.3%, 2.1% and 1.4%, which position the nut closer to the bridge, compensate for the design flaw in the "Rule of 18", allowing for any guitar, nylon string acoustic, electric, or steel string acoustic or bass guitar respectively, to achieve accurate intonation at all fret positions (assuming an adjustable bridge and proper fret location). A tempering formula is also enclosed which utilizes specific pitch offsets, which when applied to the guitar, result in extraordinarily pleasing intonation.

11 Claims, 14 Drawing Sheets

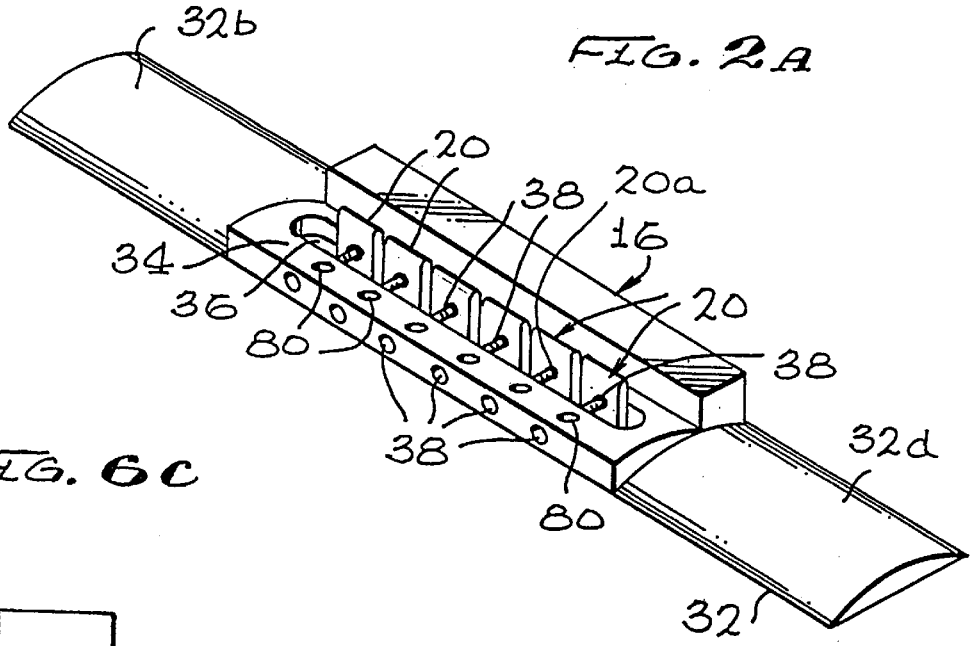
FIG. 2A
FIG. 6C
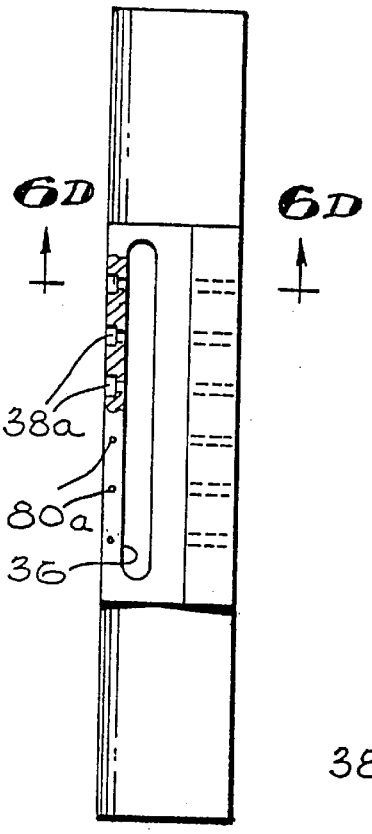
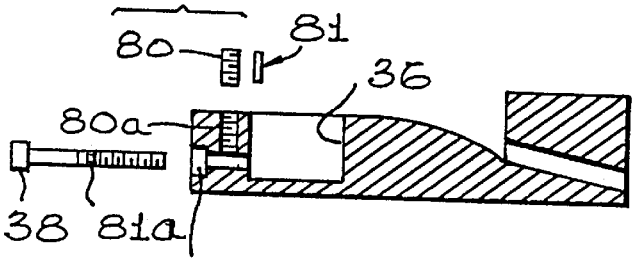
FIG. 6D
FIG. 7D
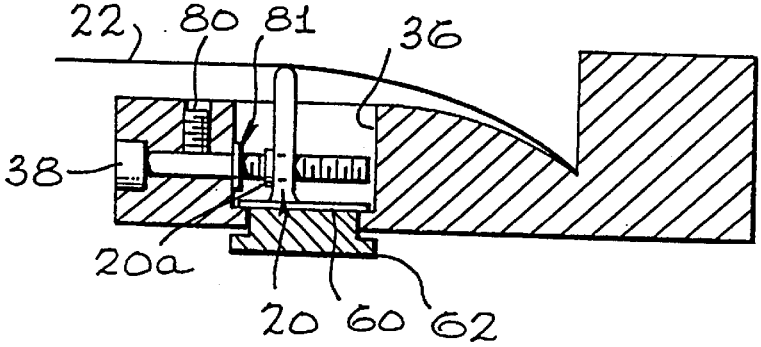

FIG. 7E
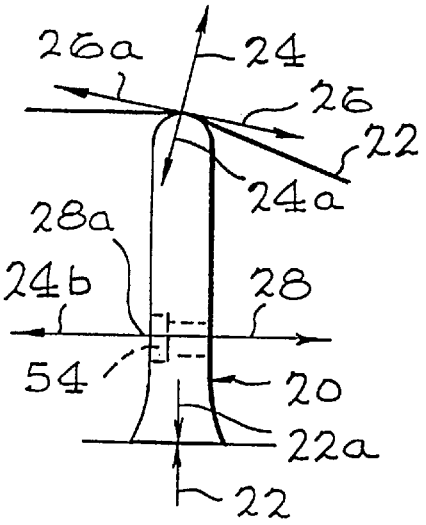
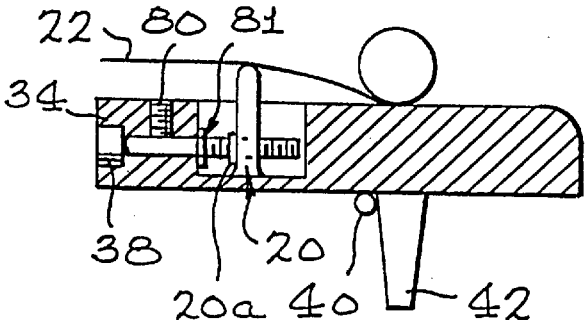
FIG. 8A
FIG. 9A
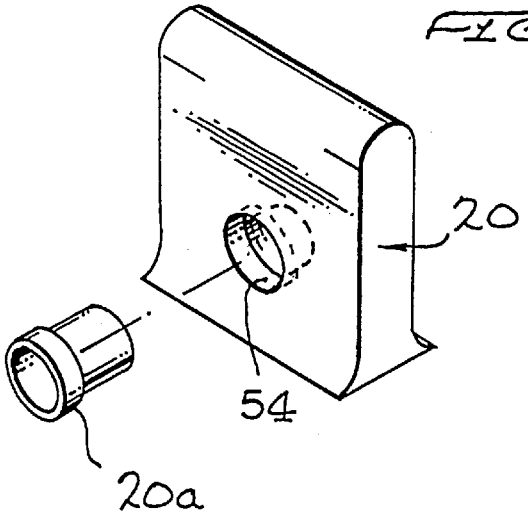
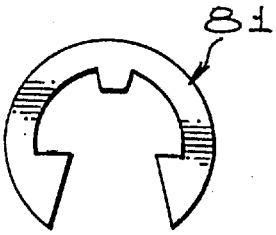
FIG. 13
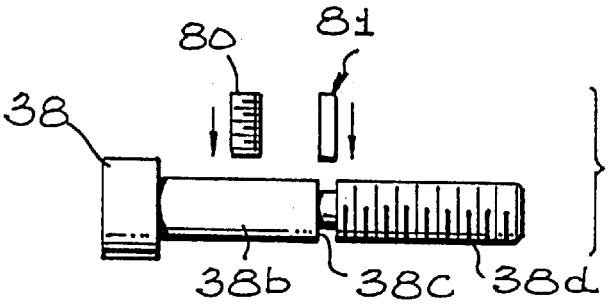
FIG. 14

FIG. 21
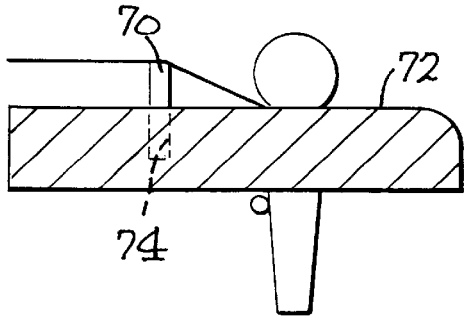
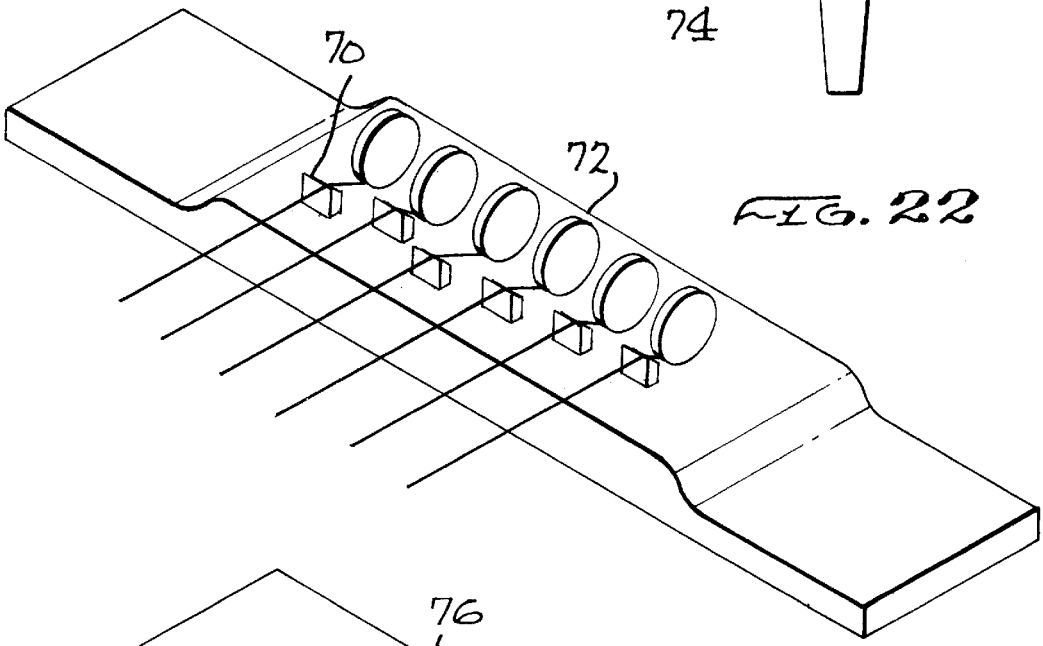
FIG. 22
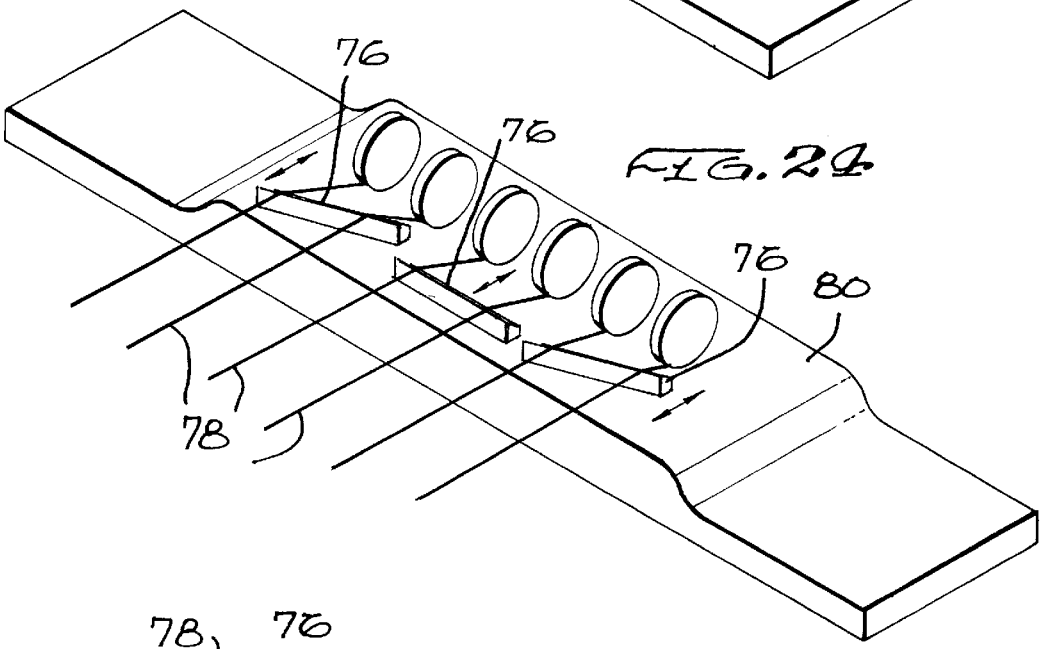
FIG. 24
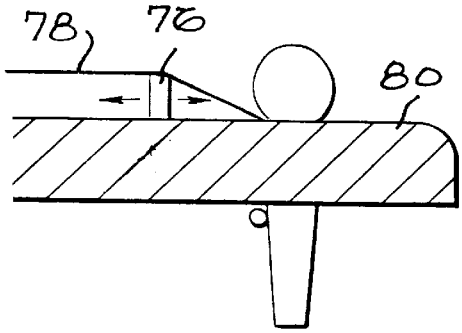
FIG. 23

FIG. 25
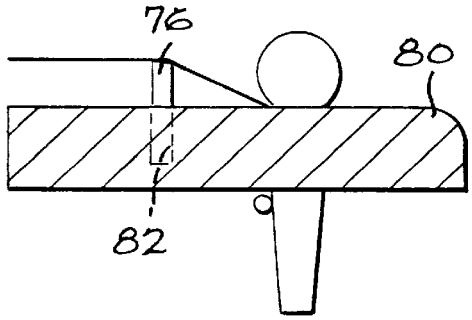
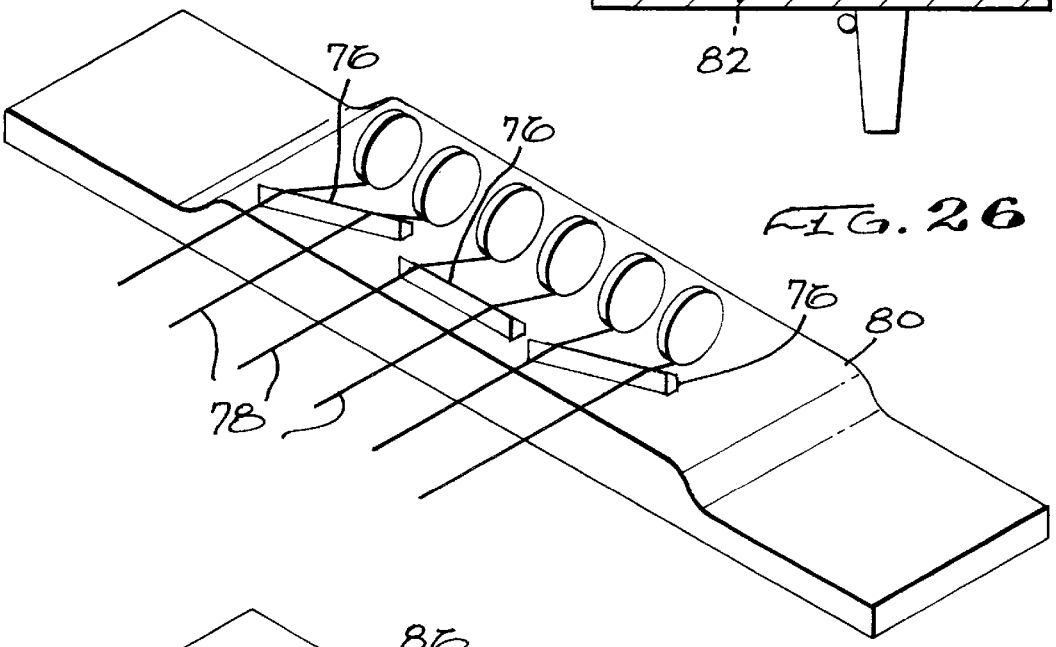
FIG. 26
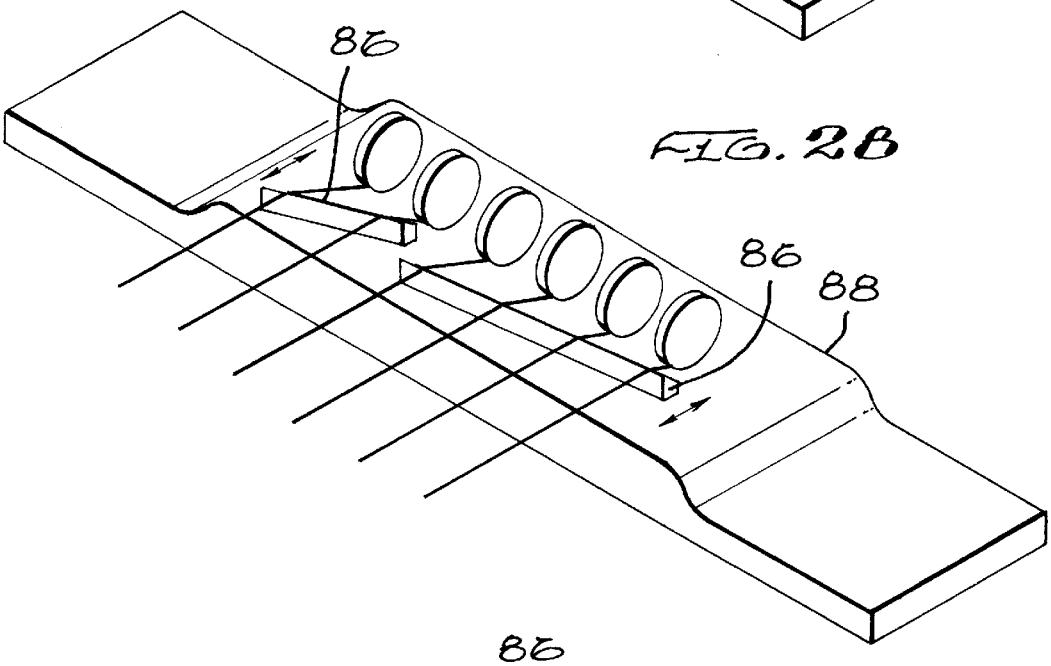
FIG. 28
FIG. 27
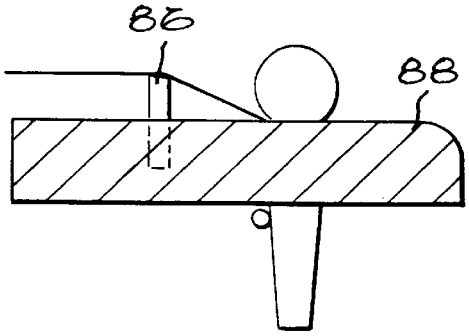

FIG 33
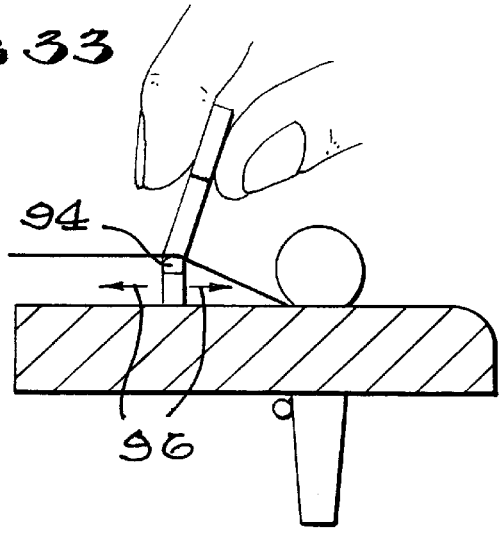
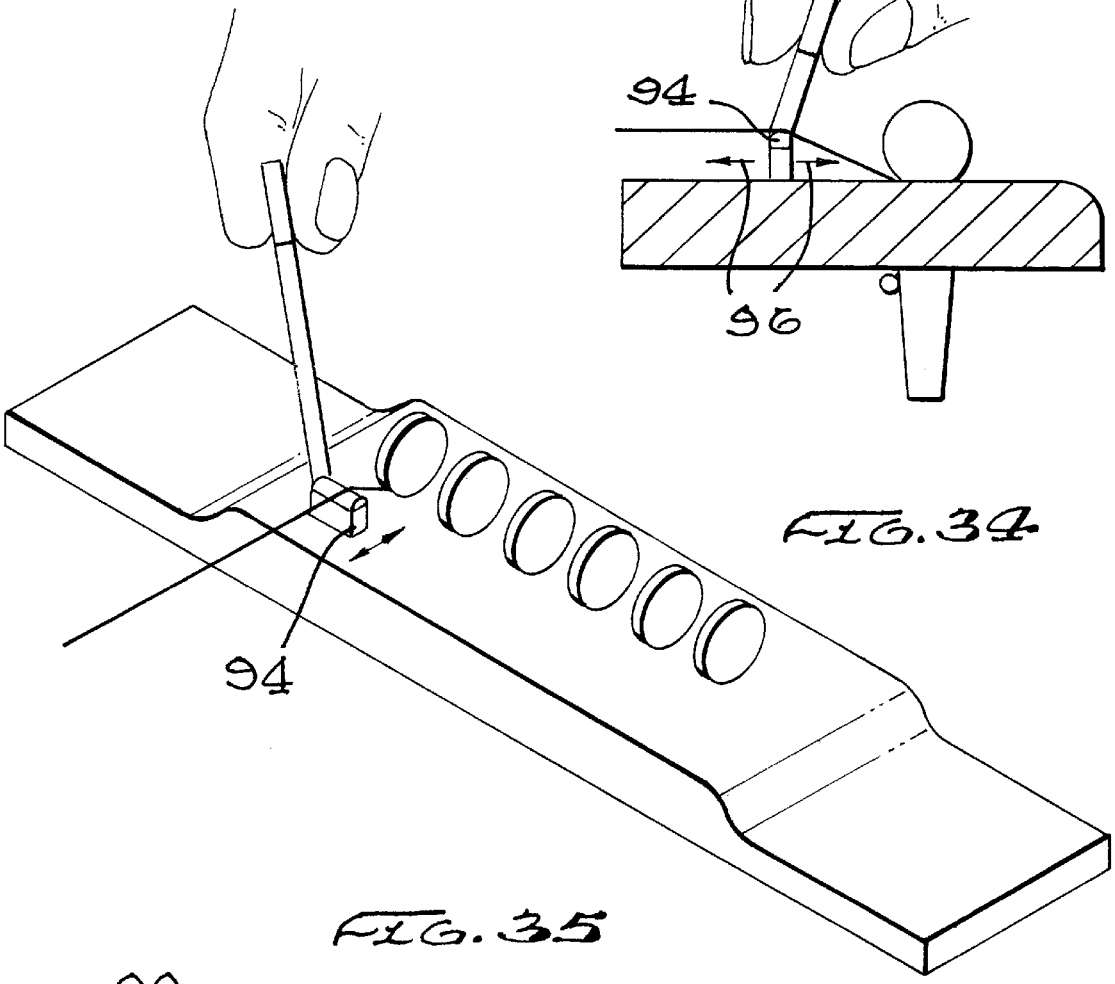
FIG. 34
FIG. 35
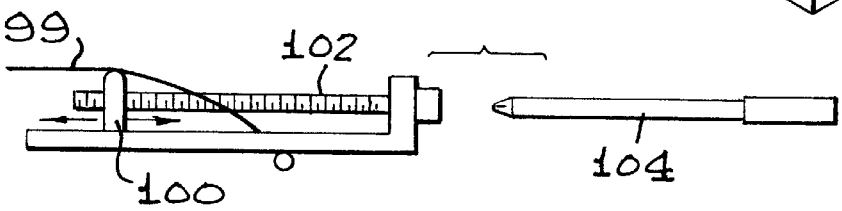
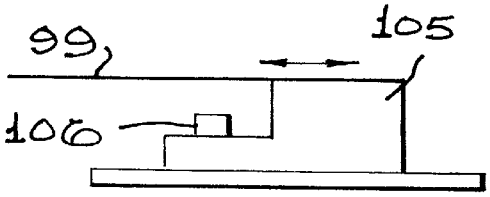
FIG. 36

METHOD AND APPARATUS FOR FULLY ADJUSTING AND PROVIDING TEMPERED INTONATION FOR STRINGED, FRETTED MUSICAL INSTRUMENTS, AND MAKING ADJUSTMENTS TO THE RULE OF 18

This is a continuation-in-part of the co-pending application Ser. No. 08/698,174, filed Aug. 15, 1996, U.S. Pat. No. 5,814,746, which is hereby incorporated by reference in its entirety, including any drawings.

FIELD OF THE INVENTION

The field of invention is adjustable guitar structures and their construction, as well as methods to accurately intonate stringed, fretted musical instruments, especially acoustic and electric guitars.

BACKGROUND OF THE INVENTION

The six-string acoustic guitar has survived many centuries without much alteration to its original design. Prior to the present invention, one very important aspect of acoustic guitars that has been overlooked is proper intonation of each string—defined as adjusting the saddle longitudinally with the string until all of the notes on the instrument are relatively in tune with each other. Traditional methods of acoustic guitar construction intonate the high and low E strings which are connected to the bridge with a straight nonadjusting saddle. The other four strings are either close to being intonated or, as in most cases, quite a bit out of intonation.

Historically, discrepancies in intonation were simply accepted by the artist and the general public, as it was not believed that perfect or proper intonation on an acoustic guitar was attainable. The artist accepted this fact by playing out of tune in various positions on the guitar, or developed a compensating playing technique to bend the strings to pitch while playing, which was difficult and/or impossible to do. Particularly in a studio setting, the acoustic guitar must play in tune with precisely intonated instruments and the professional guitarist cannot have a guitar that is even slightly off in intonation.

If, for example, the weather or temperature changes, the guitar string gauge is changed, string action (height) is raised or lowered, the guitar is refretted, or a number of any other conditions change, the guitar must be re-intonated. This especially plagues professional musicians who frequently travel or tour giving concerts around the country in different climatic zones. Such travel causes guitars to de-tune and spurs the need for adjustable intonation. Airplane travel, with the guitar being subjected to changes in altitude and pressures, exacerbates these problems. Accordingly, adjustability of intonation is desirable due to the many factors which seriously effect the acoustic guitar. Yet, most acoustic guitar companies still use the original nonadjustable single saddle.

In one aspect of the invention, the fully adjustable acoustic guitar bridge claimed herein is the only system known to the inventors that allows for continuous fully adjustable intonation of each string without sacrificing the sound of the instrument. Thus, there has been a need for the improved construction of adjustable intonation apparatus and methods to properly intonate acoustic guitars.

Attempts to properly intonate acoustic guitars have been made without success. In the 1960's, attempts were made by Gibson® with the Dove® acoustic guitar by putting a so called Nashville Tune-O-Matic bridge® on the acoustic guitar. The Tune-O-Matic was designed for electric guitars and although it theoretically allowed the acoustic guitar to be intonated, the electric guitar metal bridge destroyed the acoustic tone and qualities of the acoustic guitar. Accordingly, these guitars were believed to have been discontinued, or have not been accepted in the market, at least by professional guitar players. In the 1970's, a compensated acoustic guitar bridge was developed which cut the saddle into two or three sections and intonated the guitar strings individually with two, three, or four strings on each saddle. However, this method is not individually and continuously adjustable and thus has the major drawbacks listed above. It is important to note that traditional electric guitar bridges either have an adjustment screw running through the metal saddle, with the screw connected at both ends of the bridge (Gibson Tune-O-Matic), or springs loaded on the screw between the saddle and the bridge to help stabilize the saddle (as on a Stratocaster electric guitar). The above construction is not adaptable to acoustic guitars. On an acoustic guitar, if either the screw is connected at both ends of the bridge, or a spring is placed between the saddle and the screw, the saddle will be restricted in its vibration, thereby choking off or dampening the string vibration, resulting in lack of sustain (duration of the note's sound), or no tone or acoustic quality.

Additionally, typically, electric guitar bridges are not transferrable to acoustic guitars because electric guitar bridges are constructed of metal, which produces a bright tone with the electric guitar strings (wound steel as opposed to the acoustic guitar's wound phosphor bronze strings or nylon). The saddles on an electric guitar bridge are fixed (springs or the adjustment bolt connected at both ends of the bridge) since the pickups (guitar microphones) are located between the bridge and the neck and the electric guitar does not rely on an acoustic soundboard to project the sound. The electric guitar strings simply vibrate between two points and the vibrations are picked up by the electric guitar pickups.

The saddles for the acoustic guitar bridge typically cannot be made of metal (steel, brass, etc.). The acoustic guitar relies on the string vibrations to be transmitted from the saddles to the base of the bridge. The vibrations go from the bridge to the guitar top (soundboard) and on acoustic/electric guitars to the pickups; either internal under the bridge and/or connected against the soundboard to pickup the soundboard's vibrations. The saddle must be constructed of an acoustically resonant material (bone, phenolic, ivory, etc.) to transmit the string vibrations to the base of the bridge. Metal saddles would dampen these vibrations, and the acoustic guitar would produce a thin, brittle tone with very little or no sustain of the notes being played.

One aspect of the claimed invention solves these problems. The saddle capture has a slight bit of slop or looseness in its threading with the adjustment bolt. While round holes with clearance will work, the preferred hole is oval allowing maximum up and down freedom of movement. The saddle must have this small bit of freedom to vibrate in order to transmit string vibration into clear, full bodied tones that will ring and sustain through the projection of the acoustic guitars soundboard and/or internal pickup. In another embodiment (FIG. 6D), the set screw provides additional pressure on the saddle, eliminating any tendency of the saddle to "float" on the bridge base, providing even more sound transfer to the soundboard.

Another aspect of the present invention relates to making adjustments to the so-called Rule of 18. This aspect applies not only to acoustic guitars, but to electric guitars also. In fact, this aspect applies to any stringed instrument having frets and a nut, wherein placement of the nut has been determined by The Rule Of 18. The nut is defined as the point at which the string becomes unsupported in the direction of the bridge at the head stock end of the guitar.

After further research into the design flaw in the Rule of 18 as regards nut placement as set forth in U.S. Pat. No. 5,404,783 and in application Ser. No. 08/376,601, it became apparent that additional refinement resulted in even more accurate intonation. An additional refinement to the Rule of 3.3% compensation as set forth in the above patent and application (which is incorporated herein by reference) suggested that three separate Rules of Compensation, one for the electric guitar and two for acoustic guitars, were needed. For example, the Rule of 1.4% compensation applies to acoustic steel string guitars; for electric guitars, the Rule is 2.1% compensation. The Rule for nylon string acoustics is 3.3%.

The difference in compensation is due to decreased string tension on the electric guitars, relative to the higher tension on acoustic guitars. The decrease in overall string tension (open strings) results in more pitch distortion when playing fretted notes close to the nut (i.e. notes such as the F, F#, G, G#, etc.). The greater the pitch distortion at the $1^{st}$ fret (assuming standard nut height of 0.010"~0.020"), the more compensation in nut placement is required. Hence, we have what we call the Rule of 2.1% (or 0.030" shorter than standard 1.4312"). The correct distance from the nut to the center of the first fret slot is 1.401" on an electric guitar with standard 25–½" scale. Standard guitars are manufactured using a mathematical formula called the Rule of 18 which is used to determine the position of the frets and the nut.

A short explanation of the guitar is helpful to understanding this Rule of 18. The guitar includes six strings tuned to E, A, D, G, B, and E from the low to high strings. Metal strips running perpendicular to the strings, called frets 20, allow for other notes and chords to be played. (See FIGS. 1–4.) The positioning of the frets are determined by employing the Pythagorean Scale. The Pythagorean Scale is based upon the fourth, the fifth, and the octave interval ratios. As shown in FIG. 3, Pythagoras used a movable bridge 50 as a basis, to divide the string into two segments at these ratios. This is similar to the guitar player's finger pressing the guitar string down at selected fret locations between the bridge and the nut (FIG. 4).

To determine fret positions, guitar builders use a mathematical formula based from the work of Pythagoras called the Rule of 18 (the number used is actually 17.817). This is the distance from the nut (see FIG. 5) to the first fret. The remaining scale length is divided by 17.817 to determine the second fret location. This procedure is repeated for all of the fret locations up the guitar neck. For example, focusing on FIGS. 5A and 5B, in an acoustic guitar with a scale length of 25.511", the following calculations are appropriate:

| | | |
|---|---|---|
| 25.5 ÷ 17.817 = 1.431" | (a) | distance from nut to first fret |
| 25.5 − 1.431 = 24.0.69" | | |
| 24.069 ÷ 17.817 = 1.351" | (b) | distance between first and second fret |
| or | | |
| 1.431 + 1.351 = 2.782" | | distance from nut to second fret |

The procedure and calculations continue until the required number of frets are located.

Some altering of numbers is required to have the twelfth fret location exactly at the center of the scale length and the seventh fret producing a two-thirds ratio for the fifth interval, etc.

Unfortunately, this system is inherently deficient in that it does not result in perfect intonation. As one author stated:

> "Indeed, you can drive yourself batty trying to make the intonation perfect at every single fret. It'll simply never happen. Why? Remember what we said about the Rule of 18 and the fudging that goes on to make fret replacement come out right? That's why. Frets, by definition, are a bit of compromise, Roger Sadowsky observes. Even assuming you have your instrument professionally intonated and as perfect as it can be, your first three frets will always be a little sharp. The middle register—the 4th through the 10th frets-tends to be a little flat. The octave area tends to be accurate and the upper register tends to be either flat or sharp; your ear really can't tell the difference. That's normal for a perfectly intonated guitar." (See *The Whole Guitar Book*, "The Big Setup," Alan di Perna, p.17, *Musician* 1990.

While this prior art system is flawed, before this invention it was just an accepted fact that these were the best results that guitar makers could come up with. But even with the inventions set out in the inventor's prior patents (incorporated herein by reference), the system was not perfect. The inventor has discovered a method of intonating guitars and other stringed, fretted instruments that finally corrects additional discrepancies or deficiencies thought to be inherent in the design of the instrument.

This leads to another aspect of the invention. For centuries, the acoustic guitar has been intonated according to a standard formula, or method. That method consists of adjusting the saddle, (or saddles) so that each individual string plays "in tune" with itself at the 12th fret, meaning that an open string (for instance, "G") in the 4th octave, should be "intonated," or adjusted, so that the fretted "G" on the same string (12th fret, 5th octave) reads exactly one octave higher in pitch. This process is then repeated for all six strings, and once accomplished, results in a "perfectly" intonated guitar. The problem, however, is that this "perfectly" intonated guitar exhibits an annoying problem, one that has plagued guitarists since its invention. Certain chord shapes will sound beautiful and pleasing to the ear, while other chord shapes will sound "sour" or unpleasant to the ear. It has been a vexing and intractable problem, one that has defied all attempts to resolve it.

Efforts have been made to position the saddle more accurately, or to "compensate" the saddle (changing the witness point where the string actually leaves the saddle) so that the 12th fret note agrees more closely with the open string note, and, aided by the evolution of more precise machine tools, measuring devices, etc; we have, in fact, "perfected" this intonation method even more.

The basic problem, however, has remained and has resulted in enormous frustration for guitarists and luthiers, as well as guitar technicians, because, in spite of their best efforts to achieve "perfect" intonation, the guitar still sounds out of tune at certain chord shapes.

As indicated in the background of the invention, current intonation technology, even with the prior Feiten inventions set forth in U.S. Pat. Nos. 5,600,079 and 5,404,783, still has not resulted in pleasing intonation under the current framework using universally accepted models.

Indeed, prior artisans in the field may have even been saddled in trying to perfect a "bad", imperfect or flawed model for at least 400 years. From a historical perspective, prior to the mid 1600's, pianos or claviers had evolved from a "just" or "mean" intonation (tuning the instrument to play in only one or two related keys) to "equal temperment"; i.e., tuning the instrument so that all the notes were mathematically equidistant from each other. This method was an attempt to allow the instrument to play in a variety of unrelated keys and still sound acceptably in tune. It was only partially successful and resulted in the entire keyboard sounding slightly out of tune, especially in the upper and lower registers.

In the mid-1600's, an enormous breakthrough occurred in piano technology. The "well tempered" keyboard was conceived, and with it, a new standard for piano keyboard intonation which we still use today.

With this perspective, the inventors believe that the reason that guitars still sound out of tune, in spite of "perfect" intonation, is that the universally accepted method for intonating guitars represents a form of "equal temperment" . . . a method that was abandoned in the 1600's by piano tuners! So, what the subject invention claims is a new intonation model; i.e., a "well tempered" model specific to the guitar. There are, in fact, four separate models, one each for nylon string, steel string acoustic, electric guitar, and bass guitar, as a function of string gauges.

The term "tempering" in the context of a guitar means deliberately adjusting the length of a string at the saddle point so that the 12th fret note is slightly "out of tune." The inventor is claiming a method that results in "pleasing" intonation anywhere on the fingerboard, regardless of chord shape.

When a piano tuner intonates a piano, he uses one string as his "reference" note, typically, A-440 (or Middle "C"). He then "stretches" the intonation of the octaves, plus or minus a very small amount of pitch. These units of pitch are called "cents."

He then "tempers" the notes within the octaves so that they sound "pleasant" regardless of the key. Best wisdom in the art dictated that "tempering" a guitar was impossible, due to the fact that on a piano, one string is always the same note, whereas on a guitar, one string must play a variety of notes, leading to the universal perception that such an attempt would present an insurmountable obstacle in terms of the complexity of mathematical pitch relationships.

The inventors discovered, however, that it is possible to apply a very specific and subtle formula that adjusts or "tempers" the intonation (both open to string and 12th fret) to the instrument, so that the result, while mathematically "imperfect," sounds "pleasant" to the listener, regardless of chord shape or position on the neck.

Attempts have been made to "compensate" the saddles on a guitar to "improve" the intonation, however, the attempts have been haphazard, random, arbitrary, and unsystematic, and have not resulted in a satisfactory solution.

The inventors have thus discovered a tempering formula utilizing specific pitch offsets, which when applied to the guitar, result in extraordinarily pleasing intonation.

The concept of using specific pitch offset formulae to "temper" a guitar is a completely novel concept.

SUMMARY OF THE INVENTION

The present invention is directed to improved structures and methods to accurately intonate acoustic and electric guitars, as well as other stringed, fretted musical instruments.

The first aspect of the invention discloses an acoustic guitar that allows the strings (nylon or steel) to be intonated accurately and easily whenever necessary by use of the adjustable bridge. The bridge system employs a minimum of alternations to the traditional acoustic guitar bridge, to retain the acoustic and tonal qualities of the instrument. Moreover, the traditional appearance is less likely to receive resistance from musicians.

In one embodiment, rear loaded cap screws utilize the forward and downward pull of the guitar strings to stabilize the saddles. A threaded saddle capture on each saddle provides stability, continuous threading capability, and the freedom to use various acoustically resonant materials (bone, phenolic, composites, etc., but not metal) for saddles.

Acoustically resonant material is material which accepts sound waves (due to string vibrations) delivered to it at one point and transmits them to another source (the base of the acoustic guitar bridge), with little or no degradation of the sound waves. Examples of acoustically resonant material include bone, phenolic, ivory, etc. Although metal will transmit sound waves through it, the mass and density of metal soaks up and dampens the sound waves.

In another embodiment, recessed, front loaded cap screws utilize the downward pull of the strings and a 4-40 set screw to maximize the sound transference to the body of the guitar. (FIG. 8-A). After additional experimentation, it became apparent that insofar as the original rear loaded cap screw design (FIG. 8) eliminated the need for multi-point fasteners, the benefits derived from front loading the cap screw (i.e., centering the string on the saddle) offset the negative effect of the multipoint fastener. The set screw shown in FIG. 8-A (#80) provides an alternative method to prevent the screw from rattling, while increasing downward pressure on the saddle, thereby transferring even more vibration to the soundboard and/or electric pickup. A c-clip (FIG. 13) stabilizes the cap screw and prevents it from backing out of the hole. A 0.04011 rosewood shim is employed over the internal bridge pickup. The vibration of the saddles on the shim is transmitted to the pickup regardless whether the saddles are located directly over the pickup or not. The system has been tested and is compatible with most bridge pickup systems currently on the market.

In another aspect of the invention, the inventors discovered that the nut placement design of a standard guitar, manufactured using the standard of Rule of 18, was flawed. If a percentage (i.e., approximately 3.3%, or approximately 3/64" on a scale length of 25.5") was removed from the fingerboard at the head stock end of a nylon string guitar, perfect or near-perfect intonation was obtained due to more accurate spacing between the nut and the frets.

After extensive testing, the inventors found that nut placement could be refined even more precisely by dividing the original Rule of 3.3% compensation into three separate categories—the Feiten Rules of Compensation. The inventors derived the Rule of 3.3% by testing a nylon string guitar; then they found that lower compensation was necessary for a steel string acoustic guitar, due to the higher string tension on the steel string (resulting in less pitch distortion). Hence, the Rule of 3.3% compensation applies to acoustic nylon string guitars. The Rule of 1.4% compensation applies to acoustic steel string guitars, and bass guitars, or those acoustic-electrics using heavy gauge strings (the 0.011–0.050 set or a heavier set, and utilizing wound G string). The Rule of 2.1% compensation applies to electric guitars, or those instruments using light gauge strings (lighter than the 0.011–0.050 set with an unwound G string).

Additionally, the inventors found that after the appropriate Feiten Rule of Compensation was applied, more pleasing intonation could then be achieved by subtle pitch adjustments called tempering. Pleasant intonation is hereby defined as intonation which is pleasing regardless of where a player's fingers are on the fret board. The process of tempering is normally restricted to adjusting pianos, and entails adjusting strings by ear, or using an electronic tuner until all notes sound pleasing to the ear, in any key, anywhere on the keyboard. As past attempts to temper the guitar have been haphazard, unsystematic, and thus ultimately unsuccessful (resulting in poor intonation), the method of using a set of constant tempering pitch offsets is a revolutionary concept in guitar intonation.

The tempering process incorporated by the inventors does not consist of random adjustment. Rather, the inventors derived a combination of constant, open-string (unfretted) tuning offsets and intonation offsets (at the 12th fret). The inventors have identified multiple embodiments of constants which serve to intonate any stringed fretted instrument, hereby titled Feiten Temper Tuning Tables.

Through the combination of applying the appropriate corresponding Feiten Rule of Compensation and tempering the instrument according to a Feiten Temper Tuning Table, any stringed, fretted musical instrument can be adjusted to achieve pleasing intonation.

The concept of using specific pitch offset formulae to temper a guitar is also a completely novel concept.

BRIEF DESCRIPTION OF THE DRAWINGS

FIG. 2A shows an elevated view of another embodiment of an adjustable bridge.

FIG. 6C shows a top view and partial cross-section of another embodiment of the claimed bridge.

FIG. 6D is a section view through Section 6d—6d of FIG. 6C of the saddle adjustment feature of the invention.

FIG. 7D is another sectional view of a nylon string bridge with internal pickup.

FIG. 7E is a sectional view of a saddle, illustrating the forces applied to it by the set-screw (FIG. 7D #80).

FIG. 8A is a sectional view of another embodiment of the bridge, using a front-loaded cap screws, set-screw, and c-clip.

FIG. 9A is an elevation drawing of another embodiment of the string saddle.

FIG. 13 is a front view of the c-clip which clips tightly around a notch cut in the adjustment screw and rest firmly against the front ridge of the bridge, providing a means to securely hold the adjustment screw and saddle in place without choking off the strings vibrations.

FIG. 14 is a side view of the adjustment screw, set screw and c-clip.

FIG. 21 shows individual fixed saddles (finished saddles) connected in a groove or saddle slot formed by routing.

FIG. 22 shows the saddles set into the saddle slots.

FIG. 23 shows a cross-sectional view of three-piece saddles used to determine intonation points.

FIG. 24 is a plan view of such three-piece saddles.

FIG. 25 shows three-piece fixed saddles. Finished and placed in a saddle slot once again formed by routing.

FIG. 26 shows a plan view where the saddles are angled to compensate for the fatter strings at the bottom.

FIG. 27 shows two-piece saddles as used to determine intonation points.

FIG. 28 shows a plan view of the situation where two-piece saddles are used to establish points.

FIG. 33 shows the moving of a saddle back and forth to establish points.

FIG. 34 illustrates the movable fret method to determine points.

FIG. 35 illustrates a traditional adjustable saddle.

FIG. 36 shows how such an adjustable saddle can be moved by fingers and locked down with a screw.

DETAILED DESCRIPTION OF THE PREFERRED EMBODIMENT

Figure 1A:
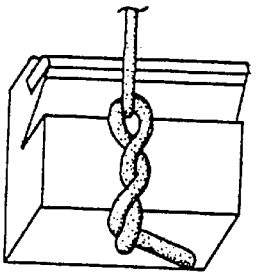
FIGS. 1A and 1B show two conventional methods of securing string to the bridge of an acoustic guitar (nylon strings).
Figure 1B:
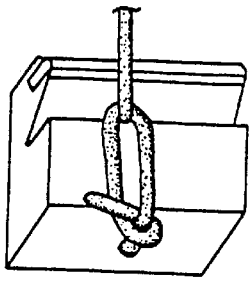
Figure 1:
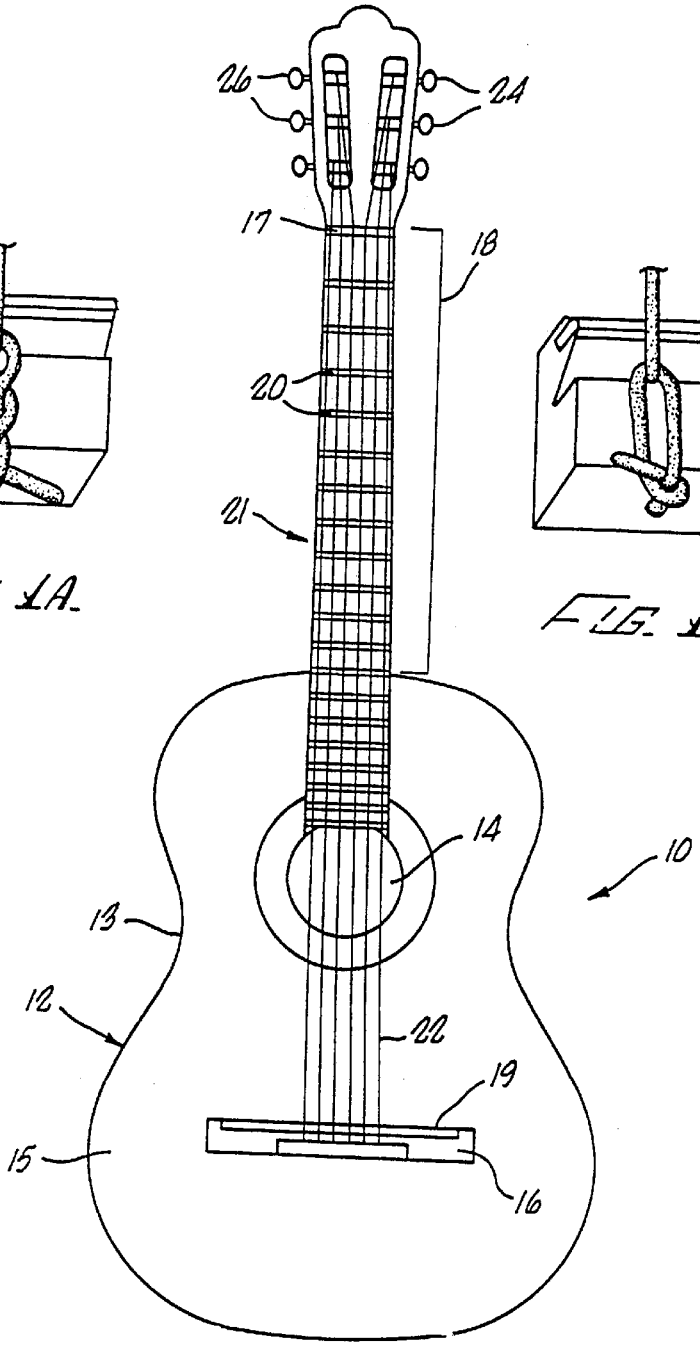
FIG. 1 shows a top view of a conventional acoustic guitar having a neck, a body, a resonant cavity or soundhole, and a bridge.
Figure 1C:
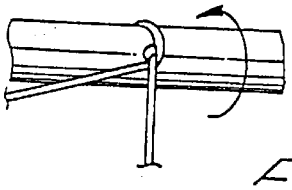
FIG. 1C. PRIOR ART
FIG. 1C shows the conventional method of securing the string to the tuning keys of an acoustic guitar.

FIG. 1 shows the basic configuration of a conventional classic acoustic guitar 10 having a guitar body 12 having sides 13 and a top or soundboard 15 on which is mounted bridge 16. Guitar strings 22 stretch over the resonant cavity or 14 and on to the head stock 24 and tuning keys 26. A bridge 16 and a saddle 19 is mounted on the top (or on the soundboard) 15 of the guitar body 12. Upraised metal ridges called frets 20 are located at designated intervals on the handle perpendicular to the strings. A typical guitar has about twenty frets. As set forth in the background of the invention, the positioning of the frets was conventionally determined by the so-called Rule of the 18. As also indicated in the Background of the Invention, conventional wisdom blindly followed this rule and led to the conclusion that proper intonation was not possible. FIG. 1 also shows the ridge 17 called the "nut", which is typically made of bone (traditional) or plastic, ivory, brass, Corian or graphite. The nut 17 is located at the end of the fingerboard 21 just before the head stock 24. It allows for the strings to be played open, (i.e., unencumbered) non-fretted notes. The nut 17 has six slots equally spaced apart, one for each string. The proper depth of the nut slot (for string) is that the string is 0.02011 above the first fret (this is a common measurement among guitar makers), to allow the open note to ring true without buzzing on the first fret. A lower spec at the first fret would allow less pressure at the lower frets (first through fifth), and result in closer proper intonation at these frets; however, the open position would be unplayable due to excessive string buzzing upon the first fret.

Figure 2:
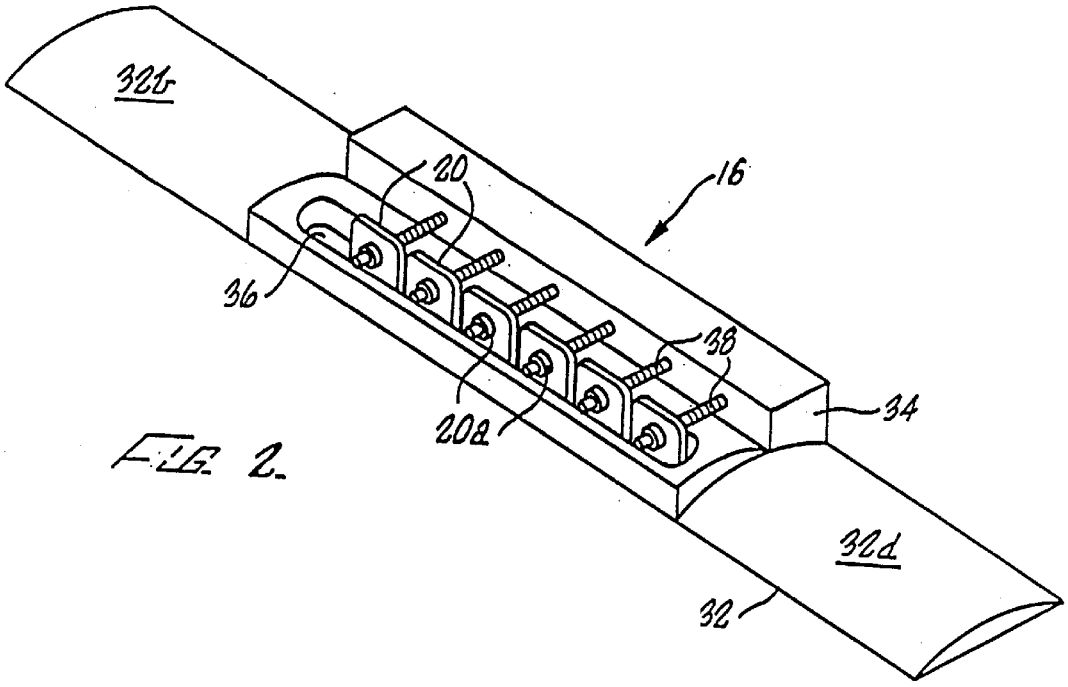
FIG. 2 shows an elevated view of the claimed fully adjustable acoustic bridge which is mounted on the guitar body.
Figure 6:
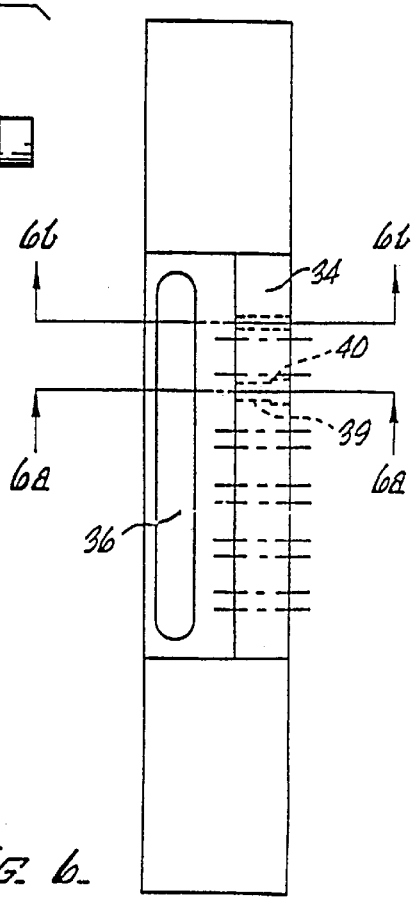
FIG. 6 shows a top view and partial cross-section of the claimed bridge.
Figure 7:
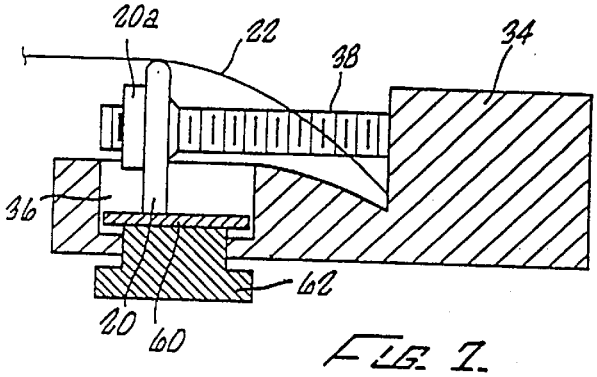
FIG. 7 is another section view of the bridge (for a nylon string acoustic guitar) with the electronic pickup embodiment, with all of the preferable parts shown, including the guitar string, saddle, capture, screw shim and internal bridge pickup.
Figure 8:
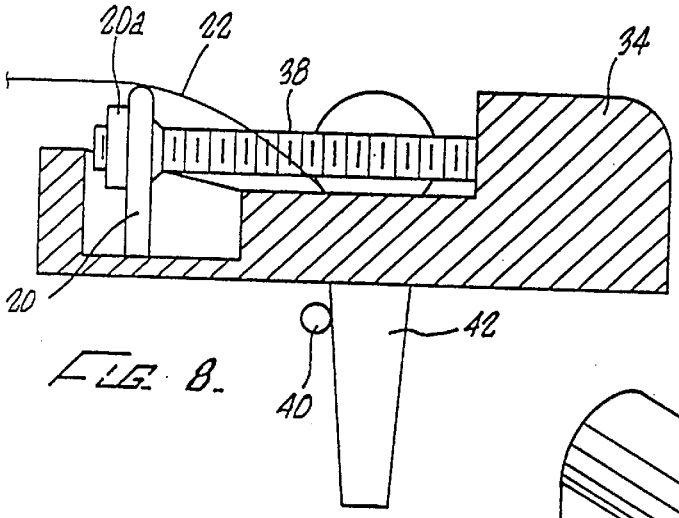
FIG. 8 is another sectional view of the bridge (for the steel string acoustic guitar) without pickup embodiment, with all of the preferable parts shown, including the guitar string, saddle, screw and shim.

FIG. 2 shows an elevated drawing of the adjustable bridge 16. The bridge utilizes individual saddles 20 which are adjustable in a direction longitudinal to the strings 22 and perpendicular to the neck 18. In the best mode, each saddle is located on a groove or trough 36. Each individual saddle has an attached threaded saddle capture 20*a*, which stabilizes and fortifies the connection between the saddles (which are typically made of non-metal or other soft material) and screws 38 which are threaded into the saddle captures. This is also shown in FIGS. 6, 7 and 8. The head of each screw is rotatably connected to the transverse boss (front ridge) 34, which extends substantially perpendicular to the strings and substantially parallel to the groove and which forms part of the frame or housing 32. Turning each screw 38 causes the movement of each connected saddle in a direction longitudinal to the strings to accomplish proper intonation. Bridge frame or housing 32 has extensions 32*a* and 32*b* which add support and optimize the picking up of the vibration off the body and from the resonant cavity.

Figure 3:
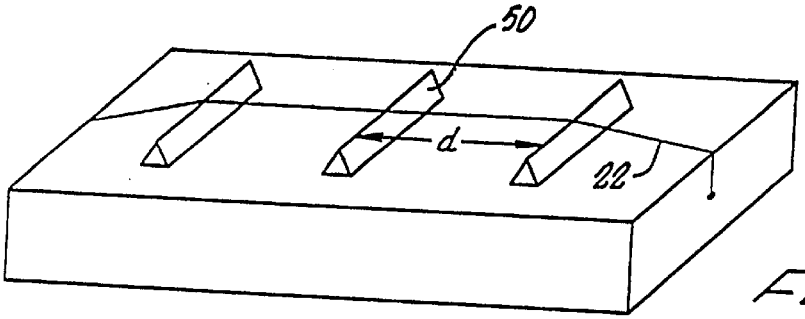
FIG. 3 is an illustrative drawing to illustrate the Pythagoras Monochord (theoretical model), utilizing a movable bridge.
Figure 4:
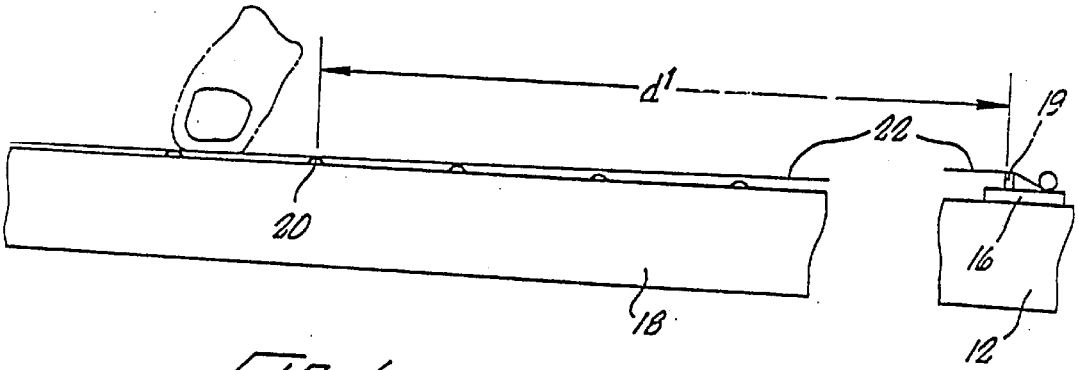
FIG. 4 shows a blown up and fragmented illustration of the relationship between the fingers, frets, saddle and bridge in the actual playing of a guitar, as compared to the theoretical model in FIG. 3.

FIG. 3 is a theoretical illustration for purposes of understanding the conventional Rule of 18. The positioning of moveable bridge or fret 50 causes shortening or lengthening of the length of the string d (FIG. 3), changing the pitch of string 52. The positioning of the frets is determined by employing the Pythagorean theory with regard to moveable bridge 50 to develop the string into segments of the desired ratio. The human finger tries to approximate this in the playing of a guitar, as illustrated in FIG. 4. When the human finger depresses the string, contact is made with an adjacent fret changing the length d' of the resonant string. The frets normally do not touch the string until the string is depressed by the human finger when the guitar is played. This helps explain one aspect of the present invention. The subject inventors appreciated that the application of the Pythagorean theory is premised on the string being under constant tension, which in fact is not the case when the guitar is actually being played and the string is under different tensions at different positions along the guitar neck when fretted by the human finger.

Figure 5A:
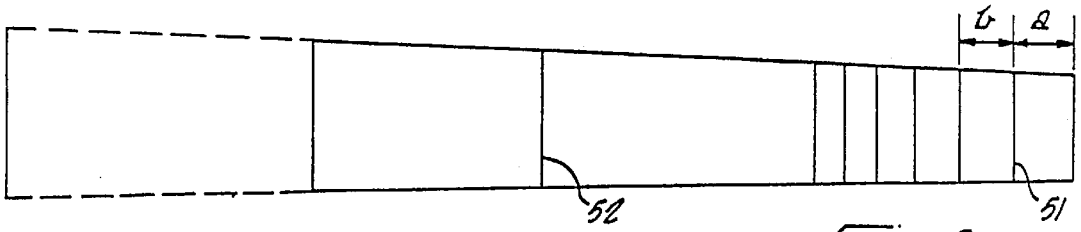
FIG. 5A shows a pictorial of the neck of a conventional guitar to explain the Rule of the 18's.
Figure 5B:
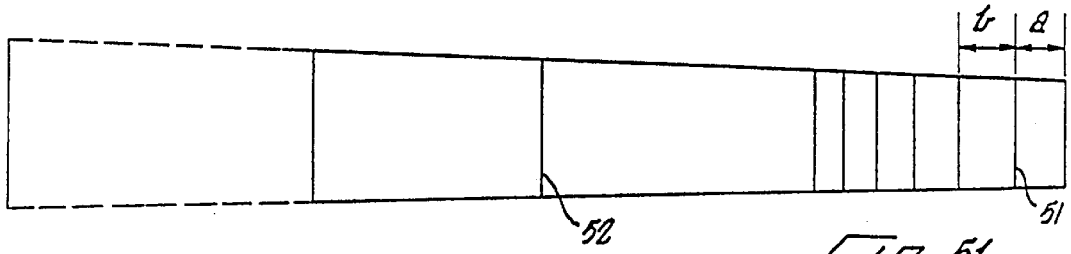
FIG. 5B shows a pictorial of the claimed guitar illustrating compensation for, and explanation of the Rule of the 3.3%. On a 25.5" scale length guitar, about 3/64" is removed from the neck.

FIGS. 5(*a*) and 5(*b*) illustrate how the Rule of the 18 is applied to position the frets on the neck of a traditional guitar, in contrast to the subject invention. FIG. 5(*a*) illustrates a traditional guitar neck. The first fret 51 is shown as being a distance away from the nut. Typically, the length of the string from the bridge to the nut is 25.5". The 12th fret 52 is also shown. The position of each fret is conventionally determined by the Rule of 18, as previously set out. Intermediate frets are not shown.

As noted, the frequency of a stretched string under constant tension is inversely proportional to its length. This is what the Pythagorean monochord represents, and is the basis from which the Rule of 18 is determined. (See FIGS. 3–5). However, what both traditional thinking and prior art failed to appreciate is the variation of string tension as the guitar player pushed on the string, making contact with different frets at different positions on the neck. The string tension is not constant when fretted along the guitar neck. It requires more pressure at the lower fret locations (e.g., near the nut 17 in FIG. 1) than it does in the upper locations (towards the bridge 16).

The traditional Rule of 18views the nut as a fret position; however, the nut is higher than the fret height to allow for the open string positions to be played. This inevitably results in lack of proper intonation, which leads to another aspect of the invention—what the inventors coined the Rule of 1.4% compensation. In the best mode, the actual number is 1.4112%. The calculations are as follows:

a. For a neck with a scale length of 25.511", the distance from the nut to the first fret is 1.4312" (by the Rule of 18).

b. For an acoustic steel string guitar, shorten this distance by 1.4%: 1.4312"×1.4% =0.0200368", or in practical manufacturing usage, 0.020 inches. Thus, 1.4312"−0.020"=1.4112".

This is the proper distance between nut and first fret for accurate intonation on an acoustic steel string guitar. The Rule of 1.4% compensation should be applied to any fretted acoustic steel string instrument, regardless of scale length, in order to achieve proper intonation. This compensation works for all common acoustic steel string gauges. For electric/acoustic instruments using heavy gauge strings (the 0.011–0.050 set or a heavier set, with wound G string), the Rule of 1.4% compensation must be applied. This includes, but is not limited to, "jazz" guitars.

The Rule of 2.1% should be applied to any stringed, fretted, electric instrument, regardless of scale length and with the exception of electric/acoustic instruments having heavy gauge strings, to achieve proper intonation. The Rule of 1.4% should be applied to fretted electric basses. The relatively larger core of electric bass strings requires the application of the Rule of 1.4% compensation to correct the intonation at the lower frets, and those above the 12th fret.

The Rule of 3.3% compensation allows for any nylon string acoustic guitar with properly located frets and an adjustable intonatable bridge to achieve accurate intonation at all fret positions. This rule has the fret locations determined as previously described by the Rule of 18with one alteration: once all fret positions are determined by the Rule of 18, one goes back to the nut and reduces the distance of the nut from the first fret by 3.3%. For a scale length of 25.5", the 3.3% compensation is 0.0472". In simple terms, one cuts 3/64" (3.3%) off of a nylon string guitar neck fingerboard at the nut end that already has its fret slots cut. The 3.3% compensation of the fingerboard compensates for the various string tensions along the neck, and for the increased string height at the nut.

Finally, once nut placement has been determined according to the appropriate Feiten Rule of Compensation, the guitar strings must be tempered according to a table of constants (the Feiten Temper Tuning Table) to achieve accurate intonation. One preferred embodiment, for electric guitar, is detailed in the following table below:

| Tuning offsets (cents) | Intonation offsets 12th fret (cents) |
|---|---|
| E +00 | E +00 |
| B +01 | B +00 |
| G −02 | G +01 |
| D −02 | D +01 |
| A −02 | A +00 |
| E −02 | E +00 |

Figure 16:
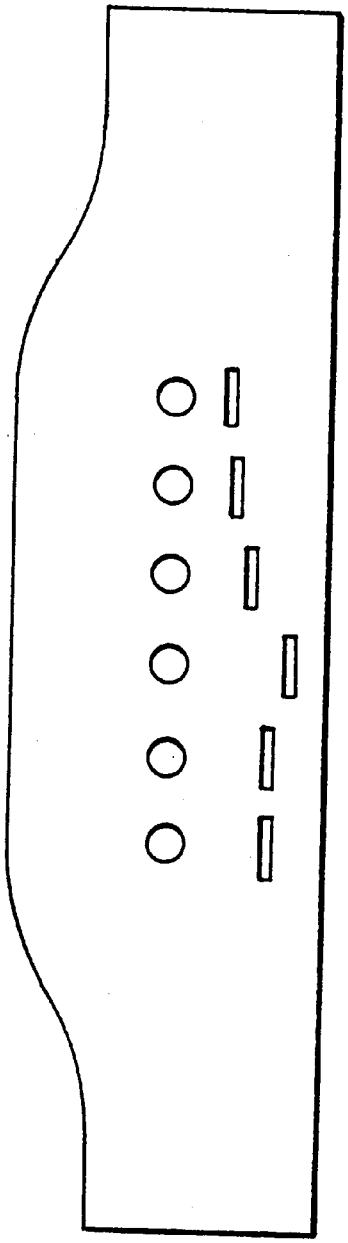
FIG. 16 shows nonadjustable split saddle bridge which allows for proper intonation at the determined points utilizing the tempered tuning system. Allows a player to experience the benefits of the tempered tuning system and the improved sound of having six individual saddles.
Figure 17:
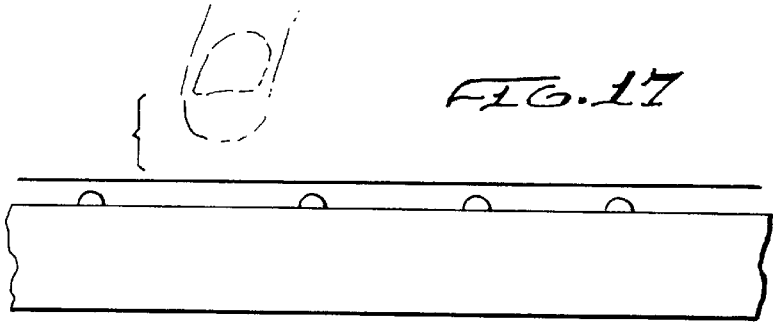
FIG. 17 shows a depiction of tuning an open string (unfretted) to a desired pitch.
Figure 18:
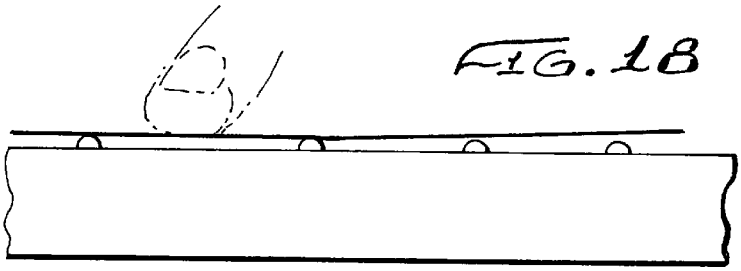
FIG. 18 similarly shows intonation at the 12th fret which divides the string length in half.

The following is best understood in relation to FIGS. 16–18. FIG. 16, for example, shows a nonadjustable split saddle bridge 120 which allows for proper intonation at the determined points 122 utilizing the tempered tuning system. It allows a player to experience the benefits of the tempered tuning system and the improved sound of having six individual saddles 124. FIG. 17 shows a depiction of tuning an open string (unfretted) to a desired pitch, while FIG. 18 similarly shows intonation at the 12th fret which divides the string length in half. While the above-mentioned table shows the preferred embodiment for an electric guitar, other Feiten Temper Tuning Tables can be applied to this type and other types of guitars (i.e., nylon, steel string acoustic), as set out below:

With regard to steel string acoustic guitars, the following steps are preferred for optimal tempering and intonations:

1. Tune open E string (5th octave) to pitch. (FIG. 17)
2. Press string at 12th fret. (FIG. 18)
3. Compare "open" string pitch with 12th fret pitch. Adjust saddle (FIG. 19) so that 12th fret pitch reads "+01" on an equal tempered tuner.
4. Tune open "B" string (5th octave) to pitch. (FIG. 17)
5. Press string at 12th fret (FIG. 18)
6. Compare "open" string pitch with 12th fret pitch. Adjust saddle (FIG. 19) so that 12th fret pitch reads "00" cents on an equal tempered tuner (such as a Yamaha PT 100 or Sanderson Accutuner which of course, will measure increments on one cent intervals).
7. Tune "G" string (4th octave) to pitch. (FIG. 17)
8. Press string at 12th fret. (FIG. 18)
9. Compare open string pitch with 12th fret pitch. Adjust saddle (FIG. 19) so that 12th fret pitch reads "+02" cents on an equal tempered tuner.
10. Tune "D" string (4th octave) to pitch. (FIG. 17)
11. Press string down at 12th fret. (FIG. 18)
12. Compare "open" string pitch with 12th fret pitch. Adjust saddle so that 12th fret pitch reads "+03" cents on an equal tempered tuner.
13. Tune open "A" string (4th octave) to "−04", using the 7th fret harmonic, but leaving the tuner set at "A".
14. Press string at 12th fret. (FIG. 18)
15. Compare "open" string pitch with 12th fret pitch. Adjust saddle so that 12th fret pitch reads "+05" cents on an equal tempered tuner.
16. Tune open "E" string (3rd octave) to "−01" cent.* (FIG. 17)
17. Press string down at 7th fret. (FIG. 18)
18. Compare "open" string pitch with 7th fret pitch. Adjust saddle so that 7th fret pitch reads "+02" cents on an equal tempered tuner.*

Figure 19:
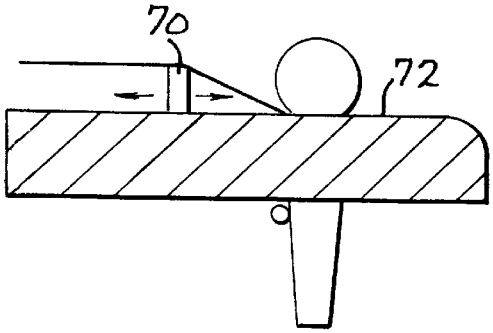
FIG. 19 shows an individual saddle used to determine the focal points.
Figure 20:
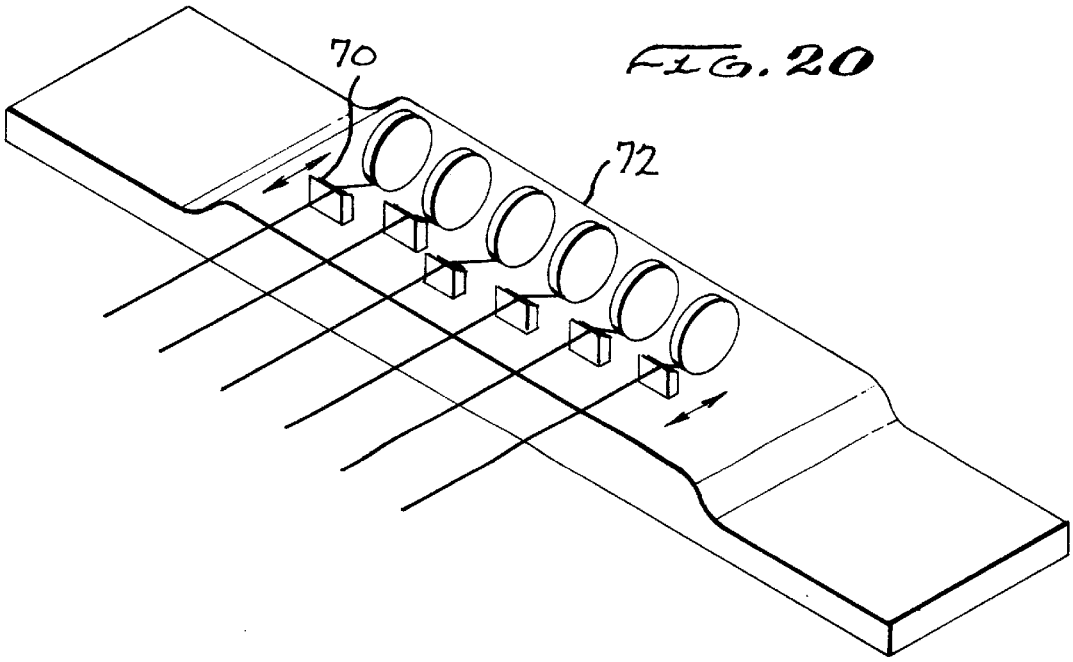
FIG. 20 shows saddles preliminarily set to desired positions by being moved closer or further away from the neck.
Figure 29:
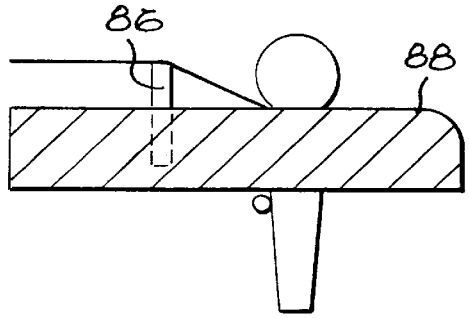
FIG. 29 shows a side-view of a two-piece fixed saddle.
Figure 30:
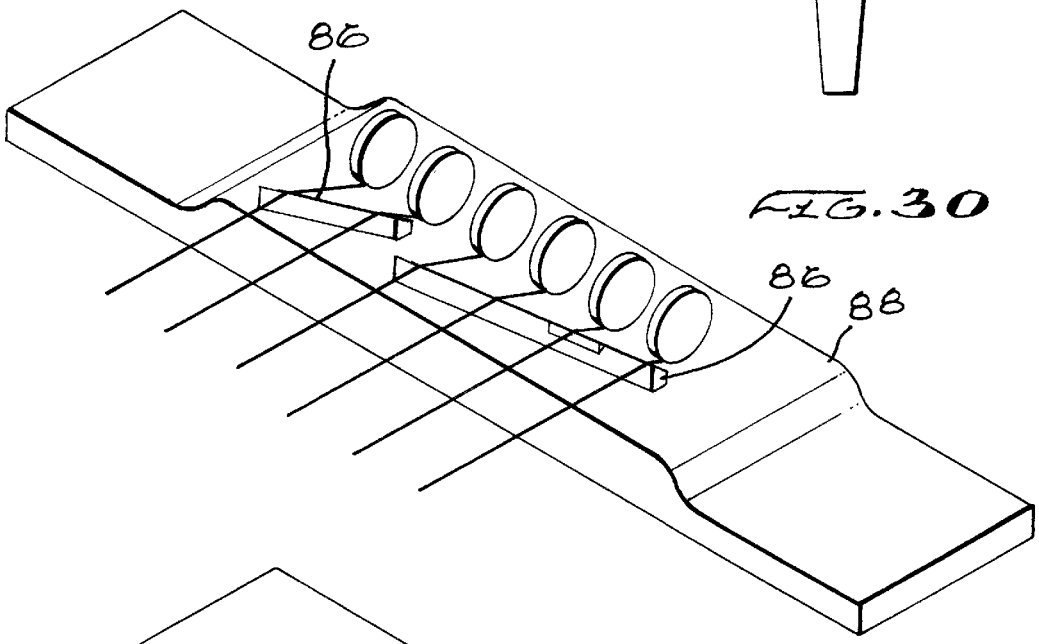
FIG. 30 shows a plan view of a two-piece fixed saddle.

There are a variety of ways to establish the "intonation points" on an acoustic guitar, including the procedure illustrated as set forth in the drawings and described below: FIG. 19 shows an individual saddle used to determine the focal points. As shown in FIGS. 19 and 20, for example, six individual saddles 70 rest atop a bridge 72 with no saddle slot. The saddles are moved back and forth (upwardly or downwardly in relation to the neck) until the "tempered" intonation points are established which process may be assisted using a Yamaha PT 100 or a Sanderson Accutuner. In FIGS. 21 and 22, the saddle slots are then cut into the bridge; (shown at 74) and the intonation points become permanent. FIG. 21 shows individual fixed saddles (finished saddles) connected in a groove or saddle slot formed by routing, while FIG. 22 shows the saddles set into the saddle slots. In FIGS. 23 and 24, three saddles, each supporting two strings 78, rest atop a bridge 80 with no saddle slot. FIG. 23 shows a cross-sectional view of three-piece saddles used to determine intonation points while FIG. 24 is a plan view of such three-piece saddles. The saddles are positioned to reflect the "tempered" intonation points. In FIGS. 25 and 26, the saddle slots are cut (shown at 82) into the bridge, and the "tempered" intonation points become permanent. FIG. 25 shows three-piece fixed saddles 84 finished and placed in a saddle slot once again formed by routing. FIG. 26 also shows a plan view where the saddles are angled to compensate for the fatter strings at the bottom. In FIGS. 27 and 28, a two-piece saddle 86 is shown resting atop a bridge 88 with no saddle slot. FIG. 27 shows two-piece saddles as used to determine intonation points while FIG. 28 shows a plan view of the situation where two-piece saddles are used to establish points. The saddle supporting two strings is positioned to establish the "tempered" intonation points. The saddle supporting four strings is positioned according to the "saddle position establishing points," in this case, the "G" and "D" strings. The remaining strings have been positioned on the saddle by grinding, filing, or machining the saddle to reflect the "tempered" intonation points. In FIGS. 29 and 30, FIG. 29 shows a side-view of a two-piece fixed saddle while FIG. 30 shows a plan view of a two-piece fixed saddle.

The "saddle position establishing points" are determined by whichever two intonation points need to be closest to the neck, in order to reflect the specific pitch offsets dictated by the Feiten Tempered Tuning Tables and still allow the remaining points to fall within the ⅛" dictated by the thickness of the saddle.

Figure 32:
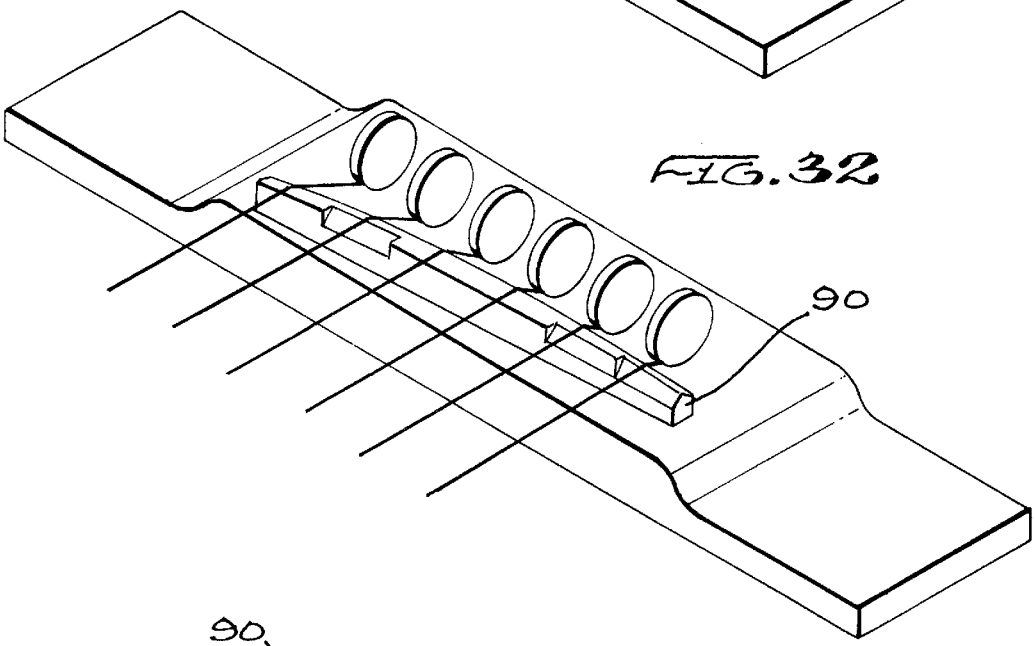
FIG. 32 is a plan view showing such a fixed saddle with the saddle position establishing points.
Figure 31:
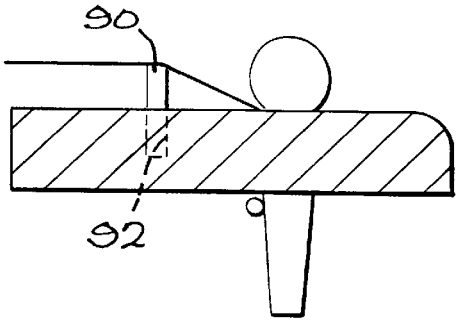
FIG. 31 shows a single-piece fixed saddle inserted in a saddle slot.

FIG. 31 shows a single-piece fixed saddle 90 inserted in a saddle slot 92 while FIG. 32 is a plan view showing such a fixed saddle 90 with the saddle position establishing points. In FIG. 33 it is shown how the saddle 94 is moved back and forth 96 to establish points. FIG. 34 illustrates the movable fret method to determine points. In FIG. 33, the saddle is moved back and forth until the desired "tempered" intonation point is established. This process is then repeated for each string, according to the specific tempering formula for the type of guitar used.

With regard to electric guitars, the following steps are preferred for optimal tempering and intonation:

1. Tune open E string (5th Octave) to pitch standard pitch (00 cents). (FIG. 17)
2. Press string at 12th fret. (FIG. 18)
3. Compare "open" string pitch with 12th fret pitch. Adjust saddle (FIGS. 35, 36) so that 12th fret pitch reads "00" on an equal tempered tuner. Again, this is our "reference" string (like A-440 on a piano) and receives no temperment.
4. Tune open "B" string (5th octave) to (+01 cents). (FIG. 17)
5. Press string at 12th fret (FIG. 18)
6. Compare "open" string pitch with 12th fret pitch. Adjust saddle (FIGS. 35, 36) so that 12th fret pitch reads "00" cents.
7. Tune open "G" string (4th octave) to −02 cents. (FIG. 17)
8. Press string at 12th fret. (FIG. 18)
9. Compare open string pitch with 12th fret pitch. Adjust saddle (FIGS. 35, 36) so that 12th fret pitch reads "+01" cents.
10. Tune open "D" string (4th octave) to −02 cents. (FIG. 17)
11. Press string at 12th fret. (FIG. 18)
12. Compare "open" string pitch with 12th fret pitch. Adjust saddle (FIGS. 35, 36) so that 12th fret pitch reads "+01" cents on an equal tempered tuner.
13. Tune open "A" string (4th octave) to −02 cents. (FIG. 17)
14. Press string at 12th fret. (FIG. 18)
15. Compare open string pitch with 12th fret pitch. Adjust saddle (FIGS. 35, 36) so that 12th fret pitch reads "00" cents.
16. Tune open "E" string (3rd octave) to "−02" cents. (FIG. 17)
17. Press string at 12th fret. (FIG. 18)
18. Compare "open" string pitch with 12th fret pitch. Adjust saddle (FIGS. 35, 36) so that 12th fret pitch reads "00" cents.

With regard to Nylon String guitars, the following steps are preferred for optimal tempering and intonation.

1. Tune open "E" string to pitch (5th octave), 00 cents. (FIG. 17)
2. Press string at 12th fret. (FIG. 18)
3. Compare "open" string pitch with 12th fret pitch. Adjust saddle (FIG. 28), so that 12th fret pitch reads "+02" cents on an equal tempered tuner.
4. Tune open "B" string (5th octave) to pitch "00". (FIG. 17)
5. Press string at 12th fret. (FIG. 18)
6. Compare "open" string pitch with 12th fret pitch. Adjust saddle (FIG. 28), so that 12th fret pitch reads "+02" cents.
7. Tune open "G" string (4th octave) to "00" cents. (FIG. 17)
8. Press string at 12th fret. (FIG. 18)
9. Compare open string pitch with 12th fret pitch. Adjust saddle (FIG. 28) so that 12th fret pitch reads "+02" cents on an equal tempered tuner.
10. Tune open "D" string (4th octave) to "00" cents. (FIG. 17)
11. Press string at 12th fret. (FIG. 18)
12. Compare "open" string pitch with 12th fret pitch. Adjust saddle (FIG. 28) so that 12th fret pitch reads "+03" cents.
13. Tune open A string (4th octave) to "00" cents.
14. Press string at 7th fret (not 12th fret!). (FIG. 18)
15. Compare open string pitch with 7th fret pitch. Adjust saddle (FIG. 28) so that 7th fret pitch reads "+02" cents.
16. Tune open "E" string (3rd octave) to "00" cents. (FIG. 17)
17. Press string at 7th fret. (FIG. 18)
18. Compare "open" string pitch with 7th fret pitch. Adjust saddle (FIG. 28) so that 7th fret pitch reads "+02" cents.

The tempering formulae described in this method are the preferred embodiments. They may be represented by the following charts or tables.

| Note | Open (Cents) | 12th Fret (Cents) |
|---|---|---|
| | Steel String Acoustic Guitar (Preferred Embodiment) | |
| E | 00 | +01 |
| B | 00 | 00 |
| G | 00 | +02 |
| D | 00 | +03 |
| A | 04 at 7th fret harmonic | +05 |
| E | −01 | (Fretted "B", 7th fret) +02 |
| | Steel String Acoustic Guitar (Alternate Embodiment) | |
| E | 00 | 00 |
| B | 00 | −01 |
| G | 00 | +01 |
| D | 00 | +01 |
| A | 00 | +01 |
| E | −01 | 00 |
| | Electric Guitar (Preferred Embodiment) | |
| E | 00 | 00 |
| B | +01 | 00 |

-continued

| Note | Open (Cents) | 12th Fret (Cents) |
|---|---|---|
| G | −02 | +01 |
| D | −02 | +01 |
| A | −02 | 00 |
| E | −02 | 00 |
| | Nylon String Guitar (Preferred Embodiment) | |
| E | 00 | +02 |
| B | 00 | +02 |
| G | 00 | +02 |
| D | 00 | +03 |
| A | 00 | (E, 7th fret, +02) |
| E | 00 | (B, 7th fret, +02) |
| | Fretted Electric Bass Guitar | |
| G | 00 | −01 |
| D | 00 | −01 |
| A | 00 | +01 |
| E | 00 | +01 (fretted "B", 7th fret) |
| 'B* | 00 | +01 (fretted "B", 7th fret) |

NOTE: Standard four-string fretted bass uses string G, D, A, E (high to low)
*Low B string is included on five- and six-string fretted basses.

The following steps 1–15 apply to fretted five- and six-string basses.

The following steps 1–12 apply to fretted fourstring basses.

With regard to fretted electric bass guitars, the following steps are preferred for optimal tempering and intonation.

1. Tune "G" string to pitch (3rd octave), 00 cents. (FIG. 17)
2. Press string at 12th fret. (FIG. 18)
3. Compare "open" string pitch with 12th fret pitch. Adjust saddle (FIG. 35), so that the 12th fret pitch reads "−01" cents on an equal tempered tuner.
4. Tune open "D" string (3rd octave) to pitch, 00 cents. (FIG. 17)
5. Press string at 12th fret (FIG. 18)
6. Compare "open" string pitch with 12th fret pitch. Adjust saddle (FIG. 35), so that 12th fret pitch reads "−01" cents on an equal tempered tuner
7. Tune open "A" string (3rd octave) to pitch 00 cents. (FIG. 17)
8. Press string at 12th fret. (FIG. 18)
9. Compare open string pitch with 12th fret pitch. Adjust saddle (FIG. 35) so that the 12th fret pitch reads "+01" cents on an equal tempered tuner.
10. Tune open "E" string (2nd octave) to "00" cents. (FIG. 17)
11. Press string at 7th fret (not at 12th fret!). (FIG. 18)
12. Compare open string pitch with 7th fret pitch. Adjust saddle (FIG. 35) so that 7th fret pitch reads "+01" cent on equal tempered tuner.
13. Tune open "B" string (2nd octave) to 00 cents. (FIG. 17)
14. Press string at 7th fret. (FIG. 18)
15. Compare open string pitch with 7th fret pitch. Adjust saddle (FIG. 35) so that 7th fret pitch reads "+01" cent on equal tempered tuner.

The best results are obtained when used in conjunction with the Rules of Compensation previously described.

With regard to nylon string guitars, the inventor discovered an alternate embodiment to the Rule of 3.3%. Experiments revealed that although the Rule of 3.3% resulted in spectacular intonation, the Rule could be adjusted to give the intonation a different "character" or "feel". The inventor discovered that by applying an alternate Rule of Compensation (moving the nut towards the bridge) 2.6%, instead of 3.3%, the intonation sounded "brighter" as experienced with pianos. Since intonation is subjective, many world class concert pianists (Vladimir Horowitz, Alicia DeLarrocha, etc.) will travel with their own personal piano tuners, because it is not so much a question of tuning "perfectly," but more a question of satisfying the particular, subjective requirements of the artist. These artists are not believed to tune to "equal temperment", the formula currently used to intonate guitars.

This is precisely the issue which the claimed invention addresses. None of the prior art of record; i.e., Macaferri, DiMarzio, Cipriani, or anyone else known to the inventors has offered a) a percentage formula that addresses the flaw in traditional nut placement regardless of scale length; b) an explanation of why traditional nut placement is flawed; i.e., Pythagoras' failure to account for the phenomenon of "end tension" in the string close to its support points, and c) no one to the inventors' knowledge has ever suggested a specific and systematic method using pitch offsets to "temper" a guitar. This is a unique and revolutionary concept. Not only is there no prior art of record regarding this tempering method, in fact, the inventors believe it was considered impossible by many skilled in the art; because the perception was that the pitch relationships were too complex to allow for correction in one area without creating more problems in another area. Indeed, laudatory statements have been received that this invention achieved satisfying, pleasing intonation, anywhere on the fingerboard, according to some of the industry's most experienced and respected professionals.

What is being claimed herein includes the idea of tempering as set forth in the preferred embodiments. There are, of course, many other tempering possibilities. Given the subjective nature of intonation, however, the inventors feel that the embodiments contained here result in the most pleasing intonation.

Figure 6A:
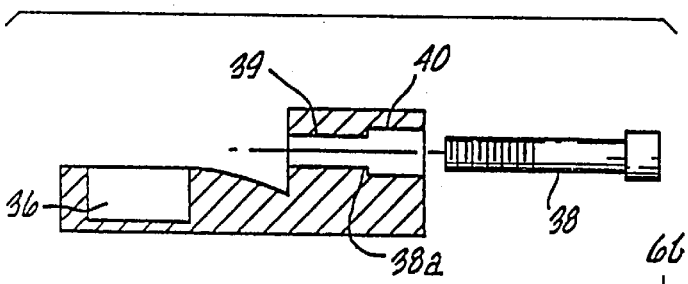
FIG. 6A is a section view through Section A—A of FIG. 6 of the saddle adjustment screw hole through the boss or ridge on the anterior portion of bridge. The hole does not contain threads and is preferably oval to limit side-to-side movement but allow up and down movement.
Figure 7A:
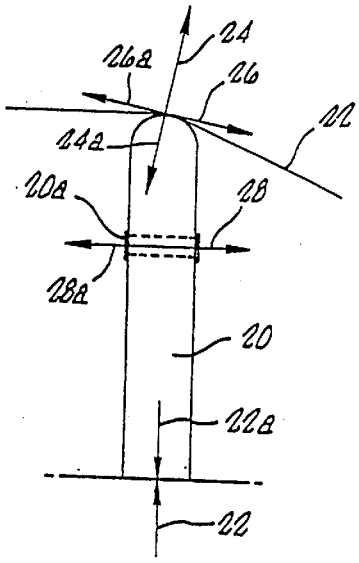
FIG. 7A is a free body diagram of the forces exerted by the string and screws on the saddle and on the pickup.

Turning now to the details of the bridge in that preferred embodiment, FIG. 6A is a section view of a typical opening within which saddle adjustment screw 38 is inserted through a hole in the boss 34 on the bridge (Section A—A). The channel 39 is slightly oversized for the 4-40 socket head cap screw which is used in the best mode. The head of the screw rests on a circular shoulder 38*a*. The hole is stepped 40 to allow seating of the screw cap. The hole 39 has clearance and the screw that contacts it is preferably not threaded. While a round hole works an oval opening is better allowing for greater freedom of movement up and down than laterally. The clearance will allow the saddle to vibrate up and down and side to side in channel 36 as it does in a normal acoustic guitar bridge system. This non-restricted motion also allows an acoustic guitar with a bridge pickup to perform to its maximum potential in an amplified situation. Most acoustic/electric guitars employ some type of piezo crystal for amplification. A piezo crystal relies on pressure acting as a vibration sensor, where each vibration pulse produces a change in current. The saddles must be allowed freedom to vibrate to let the piezo pick up all of the vibrations. Unrestricted downward pressure of the saddle on the piezo is essential; however, back and forth (longitudinally—with string) is also required to allow for intonation. A free body diagram is shown in FIG. 7A which shows the forces on saddle 20 by string 22 and capture 20*a*. Vectors 24, 24*a*, 26 and 26*a* depict stresses caused by the string tension. Vectors 22 and 22*a* show saddle-to-bridge forces. Vectors 28 and

28*a* depict approximate forces caused by stop/play action. The saddle transmits the vibrations to the bridge and/or pickup.

Figure 6B:
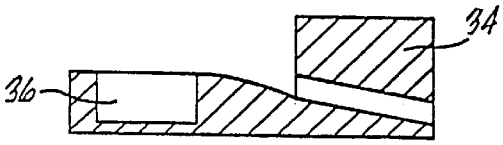
FIG. 6B a section view of the guitar string channel through the bridge taken along Section B—B of FIG. 6, showing the groove through which the string passes.

FIG. 6B is a sectional view of the guitar string channel through the bridge (Section B—B). The string can be tied in traditional classical style (over the bridge) or knotted and sent directly through the channel. In this embodiment, a nylon string bridge is shown. The steel string bridge system is the same in design except that the steel string with the ball end is held by a bridge pin 42 located between the saddle channel and the screw channel. (See FIG. 8).

FIG. 7 is a sectional view of the bridge showing all of the desired parts for nylon string application with an electronic pickup. The guitar string 22 passes through the string channel (for the nylon string embodiment) or to the bridge pin (for the steel string embodiment; e.g., FIG. 8), making contact on the top of the saddle 20 and continuing up the neck 18 to the headstock 24. The saddle is stabilized by the forward and downward pull of the guitar string and the threaded capture 20*a* and screw 38 attachment. A force diagram is shown in FIG. 7A. In the best mode, 4-40 socket head cap screws 38 are used. The screws are threaded through the capture and allow the forward to backward adjustment (intonation) of the saddle by using a 3/32" Allen wrench inserted from behind the bridge. In the best mode, the saddle rests upon a 0.04011 rosewood shim, 60, which rests upon the guitar bridge pickup 62. The saddle 20 can rest upon the solid base of the bridge on acoustic guitars without a bridge pickup. The rosewood shim 60 should be slightly undersized from the channel it sits in to allow for freedom of movement and vibration. This will prevent the string vibration from being choked off or dampened and utilize the guitar pickup to its maximum potential.

Figure 7B:
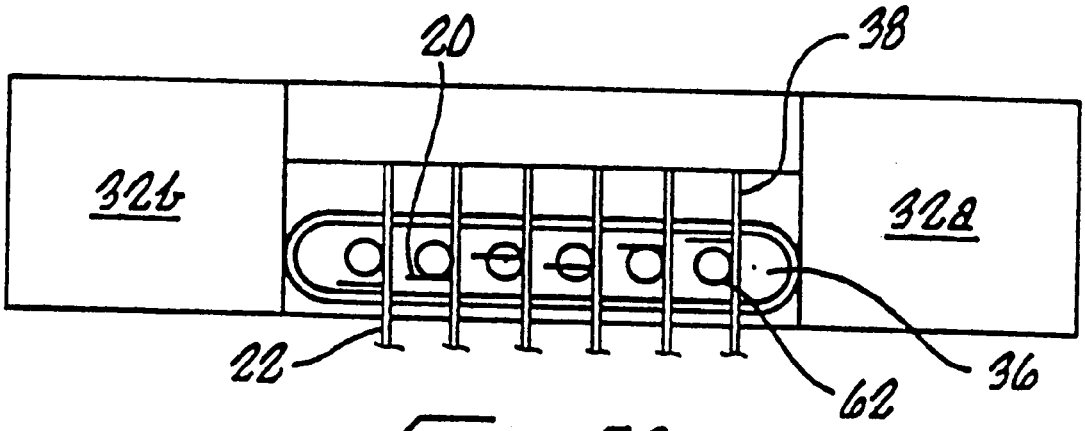
FIG. 7B is a top view of the bridge generally shown in FIG. 7 with the electronic pickup.
Figure 7C:
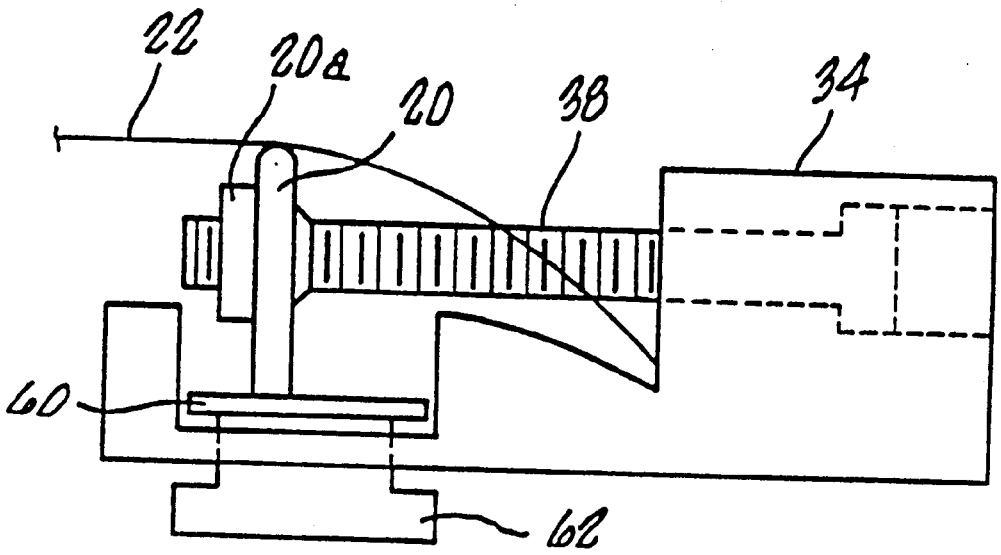
FIG. 7C is a vertical view of the apparatus in FIG. 7B.

FIG. 7*b* is a top view of the embodiment set out in FIG. 7. Individual saddle elements 20 support individual strings 22. As indicated previously, saddle capture 20*a* is in the best mode located off center. Screw 38 is threaded into off center capture 20*a*. This is also indicated in FIG. 7*c* which is a side view of the bridge shown in FIG. 7B. They are set out in the same drawing page so that both views can be looked at simultaneously by reader.

FIG. 8 illustrates another aspect of this invention, namely, utilizing a steel string and no pickup. The string ball end 40 is shown as well as bridge pin 42. The saddle is bone in the best mode.

Figure 9:
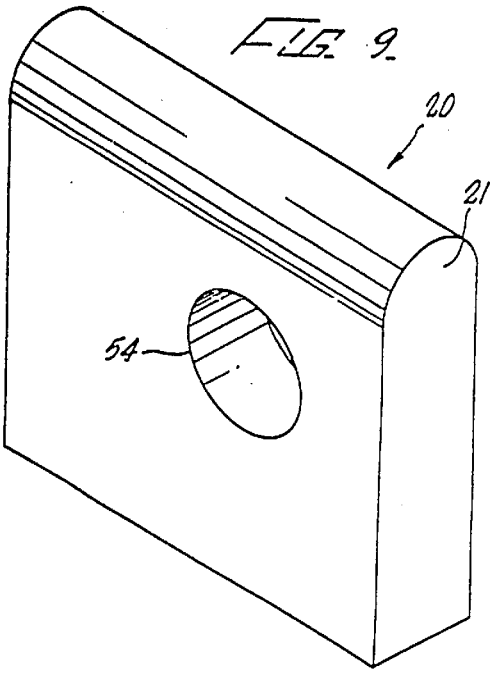
FIG. 9 is an elevation drawing of the string saddle. The claimed bridge requires six individual saddle elements so that each string can be intonated separately.

FIG. 9 is an elevated drawing of the saddle 20. The claimed bridge requires six individual longitudinally adjustable saddles, or saddle elements, upon which each string rests so that each string can be intonated separately. The bottom of each saddle element must be straight and sit flush with the base of the bridge or rosewood shim. The top of the saddle has a radius edge 21 to provide minimal string contact, necessary for intonation and tone. Hole or opening 54 is located in the saddle to hold the threaded saddle capture 20*a*. Saddle material can be traditional bone or other composite materials. It cannot be steel or non-acoustically resonant material (see Background of Invention). Research on the claimed bridge indicates the best results attained with bone for the nylon string and phenolic for the steel string. Other composites such graphite, plastic, ivory, and Corian can be used.

Figure 10:
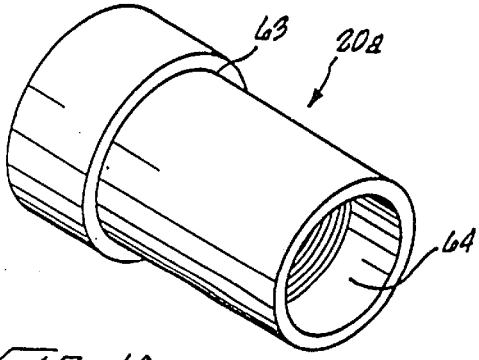
FIG. 10 is an elevated perspective of the threaded saddle capture which is attached (preferably press-fitted) to the saddle.
Figure 11:
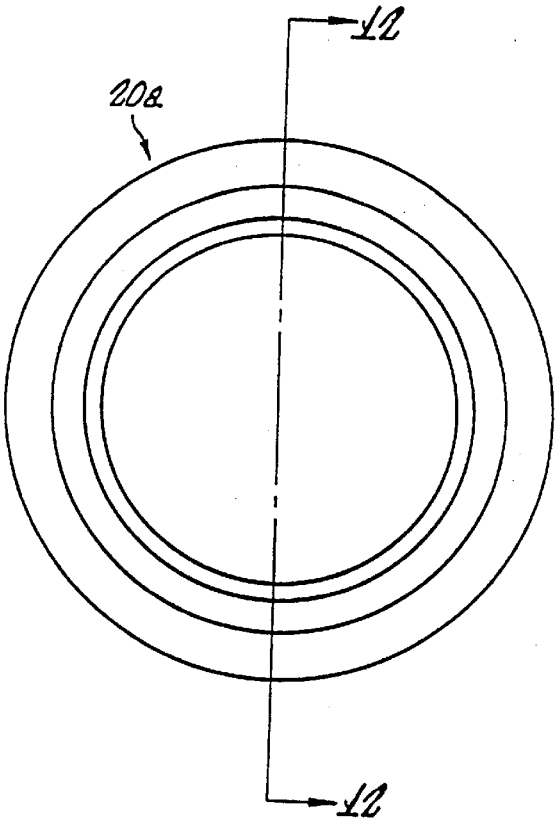
FIGS. 11 and 12 are additional drawings of the saddle capture.
Figure 12:
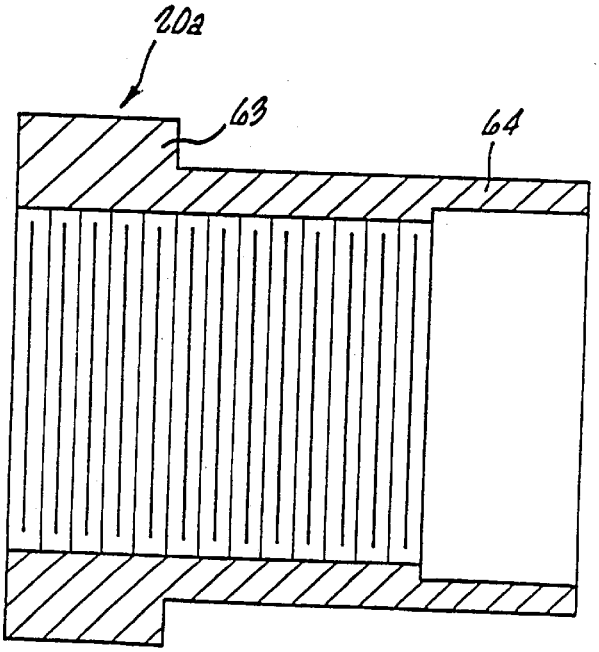
Figure 15:
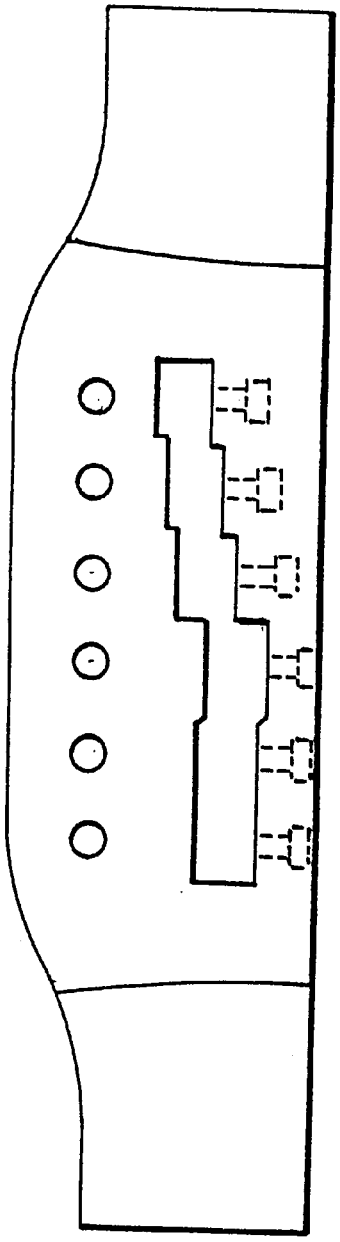
FIG. 15 shows another embodiment of adjustable bridge system with staggered troughs for the saddles and staggered screw cavities. This allows the minimum wood removal for improved tone. Staggered screw cavities allow for each screw to be the same size, therefore, each saddle will have minimum added mass to it and each saddle be connected the same.

FIG. 10 is an elevated perspective of the threaded saddle capture 20*a*. The threaded saddle capture is located in an opening or hole through the saddle and provides saddle stabilization and reliability and ease of adjustment as the intonation adjustment screw (M4-40 SOC HD CAP SCR) is threaded through for intonation adjustment. In the best mode, collar 63 is provided. Extra material 64 is used to form an adjacent collar during the press fit operation. The capture is a machined steel, brass or hard material part that becomes a permanent fixture in the saddle when inserted in the hole and pressed in a vise. Experiments have show that while use of acoustically resonant material for saddles without a capture has worked for short periods of time, a capture is needed for reliable long-life operation. The capture is offset from the string location on the saddle. In other words, the screw is not in the center of the saddle. The string is over only the saddle material, thereby directly transmitting the string vibrations unobstructed by the screw, etc. This allows the string vibrations to transmit directly through the saddle material unaffected by the mass of the capture. FIGS. 11 and 12 are additional drawings of the saddle capture. FIG. 7 also shows the rosewood shim 60. In the best mode, a 0.04011 thick rosewood shim is used between the saddle and the internal bridge pickup. Employing rosewood allows the saddle and string to vibrate as it would on an acoustic guitar without a bridge pickup. The shim must be slightly smaller than the bridge channel to permit it to freely vibrate. Rosewood also lets the vibration of the saddles on the shim to be transmitted to the pickup, regardless if the saddles are located directly over the pickup or not. This feature is necessary since the area over which the intonation of the six strings fall is larger than the width of most guitar bridge pickups.

Another embodiment of an adjustable saddle is shown in FIGS. 35 and 36. In FIG. 35 string 99 is positioned on saddle 100 cooperating with a threaded screw 102 which is adjustable using a tool such as a screwdriver or wrench 104. In FIG. 36 an adjustable saddle is shown where the saddle 105 is moved manually and then locked down with a screw 106 or similar fastener. In operation in the best mode, the claimed infinitely adjustable saddle is utilized as follows to accurately intonate a guitar: First, an open string is struck; in other words the string is struck and allowed to oscillate freely. The open string is then tuned to the "El" note using a tuner thereby setting the open string to the so called true pitch. Typical commercially available tuners can be used for this purpose.

The same string is then fretted at the 12th fret and also struck. In other words, the finger of the guitarist depresses the string so that it touches the 12th fret and the string is now only free to oscillate between the 12th fret and the bridge. This fretted note should be one octave higher than the open string note on the same string, plus or minus the specified pitch offset dictated by the Feiten Tempered Tuning Tables. A tuner once again is used to check whether the 12th fret note corresponds to the Tempered Tuning Tables.

If a discrepancy is noted, the saddle element upon which that particular string rests is longitudinally adjusted utilizing an alien wrench to turn the screw thereby longitudinally adjusting the saddle element in relation to the string. As the screw is turned, the saddle is physically adjusted by virtue of the threaded connection between the screw and the capture.

Testing and continuous adjusting is repeated until the intonation of the fretted string matches the Feiten Tempering tables for the particular application desired. This method is repeated for all other stings. As can be seen, each string is individually and infinitely adjusted so that it can be properly intonated.

While multiple embodiments and applications of this invention have been shown and described, it should be apparent that many more modifications are possible without departing from the inventive concepts therein. Both product and process claims have been included, and it is understood that the substance of some of the claims can vary and still be within the scope of this invention. The invention, therefore, can be expanded and is not to restricted except as defined in the appended claims and reasonable equivalence therefrom.

We claim:

1. The method of tempering an acoustic steel string guitar having a body with a fingerboard and a bridge, a nut located near the end of the fingerboard, a saddle located near to said bridge, strings stretched between said saddle and nut over said fingerboard, and a plurality of frets located at designated intervals on said fingerboard between the saddle and nut comprising the following steps:

(a) tuning the open E string (5th Octave) to pitch;

(b) pressing the string at the 12th fret;

(c) comparing the open string pitch with the 12th fret pitch;

(d) adjusting the saddle so that 12th fret pitch reads +01 cents on an equal tempered tuner;

(e) tuning the open B string (5th octave) to pitch;

(f) pressing the string at the 12th fret;

(g) comparing the open string pitch with the 12th fret pitch;

(h) adjusting the saddle so that the 12th fret pitch reads 00 cents on an equal tempered tuner;

(i) tuning the G string (4th octave) to pitch;

(j) pressing the string at 12th fret;

(k) comparing open string pitch with 12th fret pitch and adjusting the saddle so that the 12th fret pitch reads +02 cents on an equal tempered tuner;

(l) tuning the D string (4th octave) to pitch;

(m) pressing the string down at the 12th fret;

(n) comparing the open string pitch with 12th fret pitch and adjusting the saddle so that 12th fret pitch reads +03 cents on an equal tempered tuner;

(o) tuning the A string (4th octave) to pitch;

(p) pressing the string at the 12th fret;

(q) comparing the open string pitch with 12th fret pitch and adjusting the saddle so that 12th fret pitch reads +05 cents on an equal tempered tuner;

(r) tuning the open E string (3rd octave) to 01 cent;

(s) pressing the string down at 7th fret;

(t) comparing the open string pitch with 7th fret pitch and adjusting the saddle so that 7th fret pitch reads +02 cents on an equal tempered tuner.

2. The method of intonating an electric guitar having a body with a fingerboard and a bridge; a nut located near the end of the fingerboard, a saddle located near to said bridge, strings stretched between said saddle and nut over said fingerboard, and a plurality of frets located at designated intervals on said fingerboard between the saddle and nut comprising the following steps:

(a) tuning the open E string (5th Octave) to standard pitch (00 cents);

(b) pressing the string at 12th fret;

(c) comparing the open string pitch with 12th fret pitch and adjusting the saddle so that 12th fret pitch reads 00 cents on an equal tempered tuner;

(d) tuning the open B string (5th octave) to (+01 cents);

(e) pressing the string at the 12th fret;

(f) comparing the open string pitch with 12th fret pitch and adjusting the saddle so that the 12th fret pitch reads 00 cents;

(g) tuning the open G string (4th octave) to −02 cents;

(h) pressing the string at the 12th fret;

(i) comparing the open string pitch with 12th fret pitch and adjusting the saddle so that 12th fret pitch reads +01 cents;

(j) tuning the open D string (4th octave) to −02 cents;

(k) pressing the string at the 12th fret;

(l) comparing the open string pitch with the 12th fret pitch and adjusting the saddle so that the 12th fret pitch reads +01 cents on an equal tempered tuner;

(m) tuning the open A string (4th octave) to −02 cents;

(n) pressing the string at the 12th fret;

(o) comparing the open string pitch with the 12th fret pitch and adjusting the saddle so that the 12th fret pitch reads 00 cents;

(p) tuning the open E string (3rd octave) to 02 cents;

(q) pressing the string at 12th fret;

(r) comparing the open string pitch with the 12th fret pitch and adjusting the saddle so that the 12th fret pitch reads 00 cents.

3. The method of intonating a nylon string guitar having a body with a fingerboard and a bridge, a nut located near the end of the fingerboard, a saddle located near to said bridge; strings stretched between said saddle and nut over said fingerboard, and a plurality of frets located at designated intervals on said fingerboard between the saddle and nut comprising the following steps:

(a) tuning the open E string (5th Octave) to pitch;

(b) pressing the string at the 12th fret;

(c) comparing the open string pitch with the 12th fret pitch;

(d) adjusting the saddle so that 12th fret pitch reads +02 cents on an equal tempered tuner;

(e) tuning the open B string (5th octave) to pitch;

(f) pressing the string at the 12th fret;

(g) comparing the open string pitch with the 12th fret pitch;

(h) adjusting the saddle so that the 12th fret pitch reads +02 cents on an equal tempered tuner;

(i) tuning the G string (4th octave) to pitch;

(j) pressing the string at 12th fret;

(k) comparing open string pitch with 12th fret pitch and adjusting the saddle so that the 12th fret pitch reads +02 cents on an equal tempered tuner;

(l) tuning the D string (4th octave) to pitch;

(m) pressing the string down at the 12th fret;

(n) comparing the open string pitch with 12th fret pitch and adjusting the saddle so that 12th fret pitch reads +03 cents on an equal tempered tuner;

(o) tuning the A string (4th octave) to pitch;

(p) pressing the string at the 7th fret;

(q) comparing the open string pitch with 7th fret pitch and adjusting the saddle so that 7th fret pitch reads +02 cents on an equal tempered tuner;

(r) tuning the open E string (3rd octave) to 00 cents (standard pitch);

(s) pressing the string down at 7th fret;

(t) comparing the open string pitch with 7th fret pitch and adjusting the saddle so that 7th fret pitch reads +02 cents on an equal tempered tuner.

4. The method of tempering a steel string acoustic guitar having a body with a fingerboard and a bridge, a nut located near the end of the fingerboard, a saddle located near to said bridge, strings stretched between said saddle and nut over said fingerboard, and a plurality of frets located at designated intervals on said fingerboard between the saddle and nut in accordance with the following parameters:

| Steel String Acoustic Guitar | | |
|---|---|---|
| Note | Open (Cents) | 12th Fret |
| E | 00 | +01 |
| B | 00 | −00 |
| G | 00 | +02 |
| D | 00 | +03 |
| A | 00 | +05 |
| E | −01 | +02 at 7th fret |

5. The method of intonating a fretted electric bass guitar having a body with a fingerboard and a bridge, a nut located near the end of the fingerboard, a saddle located near to said bridge, strings stretched between said saddles and nut over said fingerboard, and a plurality of frets located at designated intervals on said fingerboard between the saddle and nut comprising the following steps:

(a) tuning the G string to pitch (3rd octave), 00 cents;

(b) pressing the string at the 12th fret;

(c) comparing the open string pitch with 12th fret pitch and adjusting the saddle, so that 12th fret pitch reads −01 cents on an equal tempered tuner;

(d) tuning the open D string (3rd octave) to pitch, 00 cents;

(e) pressing the string at the 12th fret;

(f) comparing the open string pitch with the 12th fret pitch and adjusting the saddle so that the 12th fret pitch reads −01 cents on an equal tempered tuner;

(g) tuning the open A string (3rd octave) to pitch 00 cents;

(h) pressing the string at the 12th fret;

(i) comparing the open string pitch with 12th fret pitch and adjusting the saddle so that 12th fret pitch reads +01 cents on an equal tempered tuner;

(j) tuning the open E string (2nd octave) to 00 cents;

(k) pressing the string at the 7th fret;

(l) comparing the open string pitch with 7th fret pitch and adjusting the saddle so that the 7th fret pitch reads +01 cent on equal tempered tuner;

(m) tuning the open B string (2nd octave) to 00 cents;

(n) pressing the string at the 7th fret; and (o) comparing the open string pitch with the 7th fret pitch and adjusting the saddle (FIG. 35) so that 7th fret pitch reads +01 cent on equal tempered tuner.

6. The method of tempering an electric guitar having a body with a fingerboard and a bridge; a nut located near the end of the fingerboard; a saddle located near to said bridge; strings stretched between said saddle and nut over said fingerboard; and a plurality of frets located at designated intervals on said fingerboard between the saddle and nut in accordance with the following parameters:

| Electric Guitar | | |
|---|---|---|
| Note | Open (Cents) | 12th Fret |
| E | 00 | 00 |
| B | +01 | 00 |

-continued

| Electric Guitar | | |
|---|---|---|
| Note | Open (Cents) | 12th Fret |
| G | −02 | +01 |
| D | −02 | +01 |
| A | −02 | 00 |
| E | −02 | 00 |

7. The method of tempering a nylon string guitar having a body with a fingerboard and a bridge; a nut located near the end of the fingerboard; a saddle located near to said bridge; strings stretched between said saddle and nut over said fingerboard; and a plurality of frets located at designated intervals placed on said fingerboard between the saddle and nut in accordance with the following parameters:

| Nylon String Guitar | | |
|---|---|---|
| Note | Open (Cents) | 12th Fret |
| E | 00 | +02 |
| B | 00 | +02 |
| G | 00 | +02 |
| D | 00 | +03 |
| A | 00 | +02 at 7th fret |
| E | 00 | +02 at 7th fret |

8. A stringed instrument having a neck with a nut at its distal end, a body having a bridge, and strings stretched from the nut to the bridge, wherein the tuning and intonation offsets are tempered according to constants set forth as follows for the following types of guitars:

| Note | Open (Cents) | 12th Fret |
|---|---|---|
| Steel String Acoustic Guitar | | |
| E | 00 | +01 |
| B | 00 | −00 |
| G | 00 | +02 |
| D | 00 | +03 |
| A | 00 | +05 |
| E | −01 | +02 at 7th fret |
| Electric Guitar | | |
| E | 00 | 00 |
| B | +01 | 00 |
| G | −02 | +01 |
| D | −02 | +01 |
| A | −02 | 00 |
| E | −02 | 00 |
| Nylon String Guitar | | |
| E | 00 | +02 |
| B | 00 | +02 |
| G | 00 | +02 |
| D | 00 | +03 |
| A | 00 | +02 at 7th fret |
| E | 00 | +02 at 7th fret |
| Bass Guitar | | |
| G | 00 | −01 |
| D | 00 | −01 |
| A | 00 | +01 |
| E | 00 | +01 at 7th fret) |
| B | 00 | +01 at 7th fret) |

9. A method of intonating a stringed musical instrument having a body, strings, and frets by placing the nut at a distance away from the first fret, said distance in the range of 1% to 10% shorter than standard, and wherein the tuning and intonation offsets are tempered according to constants set forth as follows depending on the guitar and strings used:

| Note | Open (Cents) | 12th Fret |
|---|---|---|
| | Steel String Acoustic Guitar | |
| E | 00 | +01 |
| B | 00 | −00 |
| G | 00 | +02 |
| D | 00 | +03 |
| A | 00 | +05 |
| E | −01 | +02 at 7th fret |
| | Electric Guitar | |
| E | 00 | 00 |
| B | +01 | 00 |
| G | −02 | +01 |
| D | −02 | +01 |
| A | −02 | 00 |
| E | −02 | 00 |
| | Nylon String Guitar | |
| E | 00 | +02 |
| B | 00 | +02 |
| G | 00 | +02 |
| D | 00 | +03 |
| A | 00 | +02 at 7th fret |
| E | 00 | +02 at 7th fret |
| | Bass Guitar | |
| G | 00 | −01 |
| D | 00 | −01 |
| A | 00 | +01 |
| E | 00 | +01 at the 7th fret) |
| B | 00 | +01 at the 7th fret) |

10. A method of intonating a stringed musical instrument having a body, strings, and frets by tempering the strings according to the constants set forth as follows:

| Note | Open (Cents) | 12th Fret |
|---|---|---|
| | Steel String Acoustic Guitar | |
| E | 00 | +01 |
| B | 00 | −00 |
| G | 00 | +02 |
| D | 00 | +03 |
| A | 00 | +05 |
| E | −01 | +02 at 7th fret |
| | Electric Guitar | |
| E | 00 | 00 |
| B | +01 | 00 |
| G | −02 | +01 |
| D | −02 | +01 |
| A | −02 | 00 |
| E | −02 | 00 |

-continued

| Note | Open (Cents) | 12th Fret |
|---|---|---|
| | Nylon String Guitar | |
| E | 00 | +02 |
| B | 00 | +02 |
| G | 00 | +02 |
| D | 00 | +03 |
| A | 00 | +02 at 7th fret |
| E | 00 | +02 at 7th fret |
| | Bass Guitar | |
| G | 00 | −01 |
| D | 00 | −01 |
| A | 00 | +01 |
| E | 00 | +01 at the 7th fret) |
| B | 00 | +01 at the 7th fret) |

11. A method of intonating a stringed musical instrument having a body, strings, and frets by placing the nut at a distance away from the first fret, said distance in the range of 1% to 10% shorter than standard, and tempering the strings according to the constants set forth as follows:

| Note | Open (Cents) | 12th Fret |
|---|---|---|
| | Steel String Acoustic Guitar | |
| E | 00 | +01 |
| B | 00 | −00 |
| G | 00 | +02 |
| D | 00 | +03 |
| A | 00 | +05 |
| E | −01 | +02 at 7th fret |
| | Electric Guitar | |
| E | 00 | 00 |
| B | +01 | 00 |
| G | −02 | +01 |
| D | −02 | +01 |
| A | −02 | 00 |
| E | −02 | 00 |
| | Nylon String Guitar | |
| E | 00 | +02 |
| B | 00 | +02 |
| G | 00 | +02 |
| D | 00 | +03 |
| A | 00 | +02 at 7th fret |
| E | 00 | +02 at 7th fret |
| | Bass Guitar | |
| G | 00 | −01 |
| D | 00 | −01 |
| A | 00 | +01 |
| E | 00 | +01 at 7th fret) |
| B | 00 | +01 at 7th fret) |

* * * * *